US008239193B2

(12) United States Patent
Oh et al.

(10) Patent No.: US 8,239,193 B2
(45) Date of Patent: Aug. 7, 2012

(54) METHOD, APPARATUS, AND MEDIUM FOR BANDWIDTH EXTENSION ENCODING AND DECODING

(75) Inventors: Eun-mi Oh, Seongnam-si (KR); Ki-hyun Choo, Seoul (KR); Jung-hoo Kim, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 12/585,569

(22) Filed: Sep. 17, 2009

(65) Prior Publication Data

US 2010/0010809 A1 Jan. 14, 2010

Related U.S. Application Data

(63) Continuation of application No. 11/976,763, filed on Oct. 26, 2007.

(30) Foreign Application Priority Data

Jan. 12, 2007 (KR) ..... 10-2007-0003963

(51) Int. Cl.
*G10L 19/04* (2006.01)

(52) U.S. Cl. ..... 704/219; 704/262; 704/269; 704/500; 704/225; 704/230

(58) Field of Classification Search ..... 704/230, 704/219, 262, 269, 500, 225
See application file for complete search history.

(56) References Cited

U.S. PATENT DOCUMENTS 6,449,596 B1 9/2002 Ejima
6,675,144 B1 * 1/2004 Tucker et al. ..... 704/264
6,680,972 B1 * 1/2004 Liljeryd et al. ..... 375/240
6,772,114 B1 8/2004 Sluijter et al.
6,889,182 B2 * 5/2005 Gustafsson ..... 704/205
7,246,065 B2 7/2007 Tanaka et al.
7,519,538 B2 * 4/2009 Villemoes et al. ..... 704/501
7,864,843 B2 * 1/2011 Choo et al. ..... 375/240.12
8,019,087 B2 * 9/2011 Goto et al. ..... 381/17
2001/0044722 A1 * 11/2001 Gustafsson et al. ..... 704/258
2002/0007273 A1 1/2002 Chen
2002/0128839 A1 * 9/2002 Lindgren et al. ..... 704/258
2002/0133335 A1 * 9/2002 Chen ..... 704/219
2003/0093271 A1 * 5/2003 Tsushima et al. ..... 704/230
2003/0093278 A1 * 5/2003 Malah ..... 704/265

(Continued)

FOREIGN PATENT DOCUMENTS

EP 1 657 710 A1 5/2006

(Continued)

OTHER PUBLICATIONS

U.S. Appl. 11/976,763, filed Oct. 26, 2007, Eun-mi Oh et al., Samsung Electronics Co., Ltd.

(Continued)

*Primary Examiner* — Eric Yen
(74) *Attorney, Agent, or Firm* — Staas & Halsey LLP

(57) ABSTRACT

Provided are a method, apparatus, and medium for encoding/decoding a high frequency band signal by using a low frequency band signal corresponding to an audio signal or a speech signal. Accordingly, since the high frequency band signal is encoded and decoded by using the low frequency band signal, encoding and decoding can be carried out with a small data size while avoiding deterioration of sound quality.

2 Claims, 16 Drawing Sheets

U.S. PATENT DOCUMENTS

| | | | | |
|---|---|---|---|---|
| 2003/0195742 | A1 | 10/2003 | Tsushima et al. | |
| 2003/0233234 | A1* | 12/2003 | Truman et al. | 704/256 |
| 2003/0233236 | A1* | 12/2003 | Davidson et al. | 704/258 |
| 2004/0019492 | A1* | 1/2004 | Tucker et al. | 704/500 |
| 2004/0024594 | A1* | 2/2004 | Lee et al. | 704/219 |
| 2004/0174911 | A1* | 9/2004 | Kim et al. | 370/538 |
| 2004/0267522 | A1* | 12/2004 | Allamanche et al. | 704/205 |
| 2005/0004793 | A1* | 1/2005 | Ojala et al. | 704/219 |
| 2005/0065783 | A1* | 3/2005 | Ojala et al. | 704/205 |
| 2005/0192798 | A1* | 9/2005 | Vainio et al. | 704/223 |
| 2005/0240399 | A1* | 10/2005 | Makinen | 704/223 |
| 2005/0246164 | A1* | 11/2005 | Ojala et al. | 704/205 |
| 2005/0267763 | A1* | 12/2005 | Ojanpera | 704/500 |
| 2006/0235678 | A1 | 10/2006 | Kim et al. | |
| 2006/0261986 | A1 | 11/2006 | Lazar | |
| 2006/0277038 | A1* | 12/2006 | Vos et al. | 704/219 |
| 2006/0277039 | A1* | 12/2006 | Vos et al. | 704/219 |
| 2007/0005353 | A1 | 1/2007 | Tsushima et al. | |
| 2007/0078661 | A1* | 4/2007 | Sriram et al. | 704/501 |
| 2007/0106502 | A1 | 5/2007 | Kim et al. | |
| 2007/0160218 | A1* | 7/2007 | Jakka et al. | 381/22 |
| 2007/0208565 | A1* | 9/2007 | Lakaniemi et al. | 704/268 |
| 2007/0225971 | A1* | 9/2007 | Bessette | 704/203 |
| 2007/0296614 | A1* | 12/2007 | Lee et al. | 341/50 |
| 2008/0027717 | A1* | 1/2008 | Rajendran et al. | 704/210 |
| 2008/0172223 | A1 | 7/2008 | Oh et al. | |
| 2009/0024399 | A1* | 1/2009 | Gartner et al. | 704/500 |
| 2009/0157393 | A1* | 6/2009 | Tsushima et al. | 704/203 |

FOREIGN PATENT DOCUMENTS

| | | |
|---|---|---|
| JP | 09-261066 | 10/1997 |
| JP | 10-083197 | 3/1998 |
| JP | 2003-514266 | 4/2003 |
| JP | 2004-004530 | 1/2004 |
| KR | 10-0647336 | 11/2006 |
| WO | 02/058052 | 7/2002 |

OTHER PUBLICATIONS

International Search Report issued by the Korean Intellectual Property Office on Mar. 4, 2008.

U.S. Notice of Allowance dated Oct. 14, 2011, mailed in copending U.S. Appl. No. 11/976,763.

U.S. Office Action dated Apr. 1, 2011, issued in the file history of U.S. Appl. No. 11/976,763.

Japanese Office Action dated Jan. 4, 2012 in corresponding Japanese Application No. 2009-545485.

Takehiro Moriya "Principles of Speech and Audio Coding and Standarization" NTT Laboratories, MPEG-4, ITC T; Sep. 16, 1999 (11 Pages) including English Abstract.

Extended European Search Report for European Application No. 07851633.3, mailed May 11, 2012.

M. Bosi et al., "ISO/IEC MPEG-2 Advanced Audio Coding", Journal of the Audio Engineering Society, New York, NY, vol. 45, No. 10, Oct. 1, 1997, pp. 789-812.

* cited by examiner

METHOD, APPARATUS, AND MEDIUM FOR BANDWIDTH EXTENSION ENCODING AND DECODING

CROSS-REFERENCE TO RELATED APPLICATIONS

This application is a continuation of U.S. patent application Ser. No. 11/976,763 filed Oct. 26, 2007, the disclosure of which is incorporated herein in its entirety by reference. This application claims priority benefit from U.S. patent application Ser. No. 11/976,763 filed on Oct. 26, 2007 and this application claims the priority benefit of Korean Patent Application No. 10-2007-0003963 filed on Jan. 12, 2007, in the Korean Intellectual Property Office, the disclosure of which is incorporated herein in its entirety by reference.

BACKGROUND

1. Field

Embodiments relate to encoding and decoding of an audio signal or a speech signal, and more particularly, to a method, apparatus, and medium for encoding and decoding a high frequency band signal by using a low frequency band signal.

2. Description of the Related Art

When an audio signal or a speech signal is encoded or decoded for the entire frequency domain, encoding or decoding is complex, and efficiency is low. In addition, much data must be transmitted by an encoding end and received by a decoding end.

SUMMARY

According to an aspect of embodiments, there is provided a method, apparatus, and medium for encoding/decoding a high frequency band signal by using a low frequency band signal.

According to an aspect of embodiments, there is provided an apparatus for bandwidth extension encoding, comprising: a band divider that divides an input signal into a low frequency band signal and a high frequency band signal; a domain determining unit that determines whether the low frequency band signal will be encoded in a frequency domain or a time domain; a frequency domain encoder that transforms the low frequency band signal to the frequency domain, controls noise, and performs quantization and lossless encoding if the low frequency band signal is determined to be encoded in the frequency domain; a time domain encoder that performs encoding using CELP (code excited linear prediction) if the low frequency band signal is determined to be encoded in the time domain; a transformer that transforms the low frequency band signal and the high frequency band signal; and a bandwidth extension encoder that encodes the transformed high frequency band signal by using the transformed low frequency band signal.

According to another aspect of embodiments, there is provided an apparatus for bandwidth extension decoding, comprising: a domain checking unit that checks whether a low frequency band signal has been encoded in a frequency domain or a time domain; a frequency domain decoder that performs lossless decoding and de-quantization, controls noise, and inverse-transforms the low frequency band signal to the time domain if the checking result shows that the low frequency band signal has been encoded in the frequency domain; a time domain decoder that performs decoding using CELP if the checking result shows that the low frequency band signal has been encoded in the time domain; a transformer that transforms the signal inverse-transformed to the time domain or the signal decoded using CELP; a bandwidth extension decoder that decodes a high frequency band signal using the transformed signal; an inverse transformer that inverse-transforms the decoded high frequency band signal; and a band synthesizer that synthesizes the signal inverse-transformed to the time domain or the signal decoded using CELP and the inverse-transformed high frequency band signal.

According to another aspect of embodiments, there is provided an apparatus for bandwidth extension encoding, comprising: a band divider that divides an input signal into a low frequency band signal and a high frequency band signal; a domain determining unit that determines whether the low frequency band signal will be encoded in a frequency domain or a time domain; a frequency domain encoder that transforms the low frequency band signal to the frequency domain, controls noise, and performs quantization and lossless encoding if the low frequency band signal is determined to be encoded in the frequency domain; a time domain encoder that performs encoding using CELP if the low frequency band signal is determined to be encoded in the time domain; a transformer that transforms the high frequency band signal and the signal encoded using CELP; and a bandwidth extension encoder that encodes the transformed high frequency band signal by using the transformed low frequency band signal.

According to another aspect of embodiments, there is provided an apparatus for bandwidth extension decoding, comprising: a domain checking unit that checks whether a low frequency band signal has been encoded in a frequency domain or a time domain; a frequency domain decoder that performs lossless decoding and de-quantization, controls noise, and inverse-transforms the low frequency band signal to the time domain if the checking result shows that the low frequency band signal has been encoded in the frequency domain; a time domain decoder that performs decoding using CELP if the checking result shows that the low frequency band signal has been encoded in the time domain; a transformer that transforms the decoded signal to the frequency domain; a bandwidth extension decoder that decodes a high frequency band signal using the signal containing controlled noise or the signal transformed to the frequency domain; an inverse transformer that inverse-transforms the decoded high frequency band signal to the time domain; and a band synthesizer that synthesizes the signal inverse-transformed to the time domain or the signal decoded using CELP and the inverse-transformed high frequency band signal.

According to another aspect of embodiments, there is provided an apparatus for bandwidth extension encoding, comprising: a domain determining unit that determines whether an input signal will be encoded in a frequency domain or a time domain for each of a plurality of sub-bands; a first transformer that divides the input signal for each sub-band so that the input signal is transformed to the time domain or the frequency domain according to a determination result of the domain determining unit; a frequency domain encoder that controls noise of sub-band signals transformed to the frequency domain and performs quantization and lossless encoding; a time domain encoder that encodes the sub-band signals transformed to the time domain using CELP; a second transformer that transforms the input signal; and a bandwidth extension encoder that encodes a high frequency band signal of the transformed input signal by using a low frequency band signal of the transformed input signal.

According to another aspect of embodiments, there is provided an apparatus for bandwidth extension decoding, comprising: a domain checking unit that checks whether each of a plurality of sub-band signals has been encoded in a frequency domain or a time domain; a frequency domain decoder that losslessly decodes the sub-band signals encoded in the frequency domain, performs de-quantization, and controls noise; a time domain decoder that decode the sub-band signals encoded in the time domain using CELP; a first inverse transformer that synthesizes the sub-band signals each containing controlled noise and the decoded sub-band signals and inverse-transforms the synthesized signal to the time domain; a transformer that transforms the inverse-transformed signal; a bandwidth extension decoder that decodes a high frequency band signal using the transformed signal; and a second inverse transformer that inverse-transforms the decoded signal.

According to another aspect of embodiments, there is provided an apparatus for bandwidth extension encoding, comprising: a domain determining unit that determines whether an input signal will be encoded in a frequency domain or a time domain for each of a plurality of sub-bands; a first transformer that divides the input signal for each sub-band so that the input signal is transformed to the time domain or the frequency domain according to a determination result of the domain determining unit; a frequency domain encoder that controls noise of sub-band signals transformed to the frequency domain and performs quantization and lossless encoding; a time domain encoder that encodes the sub-band signals transformed to the time domain using CELP; a bandwidth extension encoder that encodes a high frequency band signal using the transformed sub-band signals.

According to another aspect of embodiments, there is provided an apparatus for bandwidth extension decoding, comprising: a domain checking unit that checks whether each of a plurality of sub-band signals has been encoded in a frequency domain or a time domain; a frequency domain decoder that losslessly decodes the sub-band signals encoded in the frequency domain, performs de-quantization, and controls noise; a time domain decoder that decode the sub-band signals encoded in the time domain using CELP; a transformer that transforms the decoded signal to the frequency domain; a bandwidth extension decoder that decodes a high frequency band signal using the signal containing controlled noise and the transformed signal; and an inverse transformer that synthesizes the sub-band signals and inverse-transforms the synthesized signal to the time domain.

According to another aspect of embodiments, there is provided a method of bandwidth extension encoding, comprising: dividing an input signal into a low frequency band signal and a high frequency band signal; determining whether the low frequency band signal will be encoded in a frequency domain or a time domain; transforming the low frequency band signal to the frequency domain, controlling noise, and performing quantization and lossless encoding if the low frequency band signal is determined to be encoded in the frequency domain; performing encoding using CELP if the low frequency band signal is determined to be encoded in the time domain; transforming the low frequency band signal and the high frequency band signal; and encoding the transformed high frequency band signal by using the transformed low frequency band signal.

According to another aspect of embodiments, there is provided a method of bandwidth extension decoding, comprising: checking whether a low frequency band signal has been encoded in a frequency domain or a time domain; performing lossless decoding and de-quantization, controlling noise, and inverse-transforming the low frequency band signal to the time domain if the checking result shows that low frequency band signal has been encoded in the frequency domain; performing decoding using CELP if the checking result shows that low frequency band signal has been encoded in the time domain; transforming the signal inverse-transformed to the time domain or the signal decoded using CELP; decoding a high frequency band signal using the transformed signal; inverse-transforming the decoded high frequency band signal; and synthesizing the signal inverse-transformed to the time domain or the signal decoded using CELP and the inverse-transformed high frequency band signal.

According to another aspect of embodiments, there is provided a method of bandwidth extension encoding, comprising: dividing an input signal into a low frequency band signal and a high frequency band signal; determining whether the low frequency band signal will be encoded in a frequency domain or a time domain; transforming the low frequency band signal to the frequency domain, controlling noise, and performing quantization and lossless encoding if the low frequency band signal is determined to be encoded in the frequency domain; performing encoding using CELP if the low frequency band signal is determined to be encoded in the time domain; transforming the high frequency band signal and the signal encoded using CELP; and encoding the transformed high frequency band signal by using the transformed low frequency band signal.

According to another aspect of embodiments, there is provided a method of bandwidth extension decoding, comprising: checking whether a low frequency band signal has been encoded in a frequency domain or a time domain; performing lossless decoding and de-quantization, controlling noise, and inverse-transforming the low frequency band signal to the time domain if the checking result shows that the low frequency band signal has been encoded in the frequency domain; performing decoding using CELP if the checking result shows that the low frequency band signal has been encoded in the time domain; transforming the decoded signal to the frequency domain; decoding a high frequency band signal using the signal containing controlled noise or the signal transformed to the frequency domain; inverse-transforming the decoded high frequency band signal to the time domain; and synthesizing the signal inverse-transformed to the time domain or the signal decoded using CELP and the inverse-transformed high frequency band signal.

According to another aspect of embodiments, there is provided a method of bandwidth extension encoding, comprising: determining whether an input signal will be encoded in a frequency domain and a time domain for each of a plurality of sub-bands; dividing the input signal for each sub-band so that the input signal is transformed to the time domain or the frequency domain according to a determination result of the determining operation; controlling noise of sub-band signals transformed to the frequency domain and performing quantization and lossless encoding; encoding the sub-band signals transformed to the time domain using CELP; transforming the input signal; and encoding a high frequency band signal of the transformed input signal by using a low frequency band signal of the transformed input signal.

According to another aspect of embodiments, there is provided a method of bandwidth extension decoding, comprising: checking whether each of a plurality of sub-band signals has been encoded in a frequency domain or a time domain; losslessly decoding the sub-band signals encoded in the frequency domain; decoding the sub-band signals encoded in the time domain using CELP; synthesizing the sub-band signals each containing controlled noise and the decoded sub-band signals and inverse-transforming the synthesized signal to the time domain; transforming the inverse-transformed signal; decoding a high frequency band signal using the transformed signal; and inverse-transforming the decoded signal.

According to another aspect of embodiments, there is provided a method of bandwidth extension encoding, comprising: determining whether an input signal will be encoded in a frequency domain and a time domain for each of a plurality of sub-bands; dividing the input signal for each sub-band so that the input signal is transformed to the time domain or the frequency domain according to a determination result of the determining operation; controlling noise of sub-band signals transformed to the frequency domain and performing quantization and lossless encoding; encoding the sub-band signals transformed to the time domain using CELP; encoding a high frequency band signal by using the transformed sub-band signals.

According to another aspect of embodiments, there is provided a method of bandwidth extension decoding, comprising: checking whether each of a plurality of sub-band signals has been encoded in a frequency domain or a time domain; losslessly decoding the sub-band signals encoded in the frequency domain, performing de-quantization, and controlling noise; decoding the sub-band signals encoded in the time domain using CELP; transforming the decoded signal to the frequency domain; decoding a high frequency band signal using the signal containing controlled noise and the transformed signal; and synthesizing the sub-band signals and inverse-transforming the synthesized signal to the time domain.

According to another aspect of embodiments, there is provided a computer-readable medium having embodied thereon a computer program for executing a method of bandwidth extension encoding, the method comprising: dividing an input signal into a low frequency band signal and a high frequency band signal; determining whether the low frequency band signal will be encoded in a frequency domain or a time domain; transforming the low frequency band signal to the frequency domain, controlling noise, and performing quantization and lossless encoding if the low frequency band signal is determined to be encoded in the frequency domain; performing encoding using CELP if the low frequency band signal is determined to be encoded in the time domain; transforming the low frequency band signal and the high frequency band signal; and encoding the transformed high frequency band signal by using the transformed low frequency band signal.

According to another aspect of embodiments, there is provided a computer-readable medium having embodied thereon a computer program for executing a method of bandwidth extension decoding, the method comprising: checking whether a low frequency band signal has been encoded in a frequency domain or a time domain; performing lossless decoding and de-quantization, controlling noise, and inverse-transforming the low frequency band signal to the time domain if the checking result shows that low frequency band signal has been encoded in the frequency domain; performing decoding using CELP if the checking result shows that low frequency band signal has been encoded in the time domain; transforming the signal inverse-transformed to the time domain or the signal decoded using CELP; decoding a high frequency band signal using the transformed signal; inverse-transforming the decoded high frequency band signal; and synthesizing the signal inverse-transformed to the time domain or the signal decoded using CELP and the inverse-transformed high frequency band signal.

According to another aspect of embodiments, there is provided a computer-readable medium having embodied thereon a computer program for executing a method of bandwidth extension encoding, the method comprising: dividing an input signal into a low frequency band signal and a high frequency band signal; determining whether the low frequency band signal will be encoded in a frequency domain or a time domain; transforming the low frequency band signal to the frequency domain, controlling noise, and performing quantization and lossless encoding if the low frequency band signal is determined to be encoded in the frequency domain; performing encoding using CELP if the low frequency band signal is determined to be encoded in the time domain; transforming the high frequency band signal and the signal encoded using CELP; and encoding the transformed high frequency band signal by using the transformed low frequency band signal.

According to another aspect of embodiments, there is provided a computer-readable medium having embodied thereon a computer program for executing a method of bandwidth extension decoding, the method comprising: checking whether a low frequency band signal has been encoded in a frequency domain or a time domain; performing lossless decoding and de-quantization, controlling noise, and inverse-transforming the low frequency band signal to the time domain if the checking result shows that the low frequency band signal has been encoded in the frequency domain; performing decoding using CELP if the checking result shows that the low frequency band signal has been encoded in the time domain; transforming the decoded signal to the frequency domain; decoding a high frequency band signal using the signal containing controlled noise or the signal transformed to the frequency domain; inverse-transforming the decoded high frequency band signal to the time domain; and synthesizing the signal inverse-transformed to the time domain or the signal decoded using CELP and the inverse-transformed high frequency band signal.

According to another aspect of embodiments, there is provided a computer-readable medium having embodied thereon a computer program for executing a method of bandwidth extension encoding, the method comprising: determining whether an input signal will be encoded in a frequency domain and a time domain for each of a plurality of sub-bands; dividing the input signal for each sub-band so that the input signal is transformed to the time domain or the frequency domain according to a determination result of the determining operation; controlling noise of sub-band signals transformed to the frequency domain and performing quantization and lossless encoding; encoding the sub-band signals transformed to the time domain using CELP; transforming the input signal; and encoding a high frequency band signal of the transformed input signal by using a low frequency band signal of the transformed input signal.

According to another aspect of embodiments, there is provided a computer-readable medium having embodied thereon a computer program for executing a method of bandwidth extension decoding, the method comprising: checking whether each of a plurality of sub-band signals has been encoded in a frequency domain or a time domain; losslessly decoding the sub-band signals encoded in the frequency domain; decoding the sub-band signals encoded in the time domain using CELP; synthesizing the sub-band signals each containing controlled noise and the decoded sub-band signals and inverse-transforming the synthesized signal to the time domain; transforming the inverse-transformed signal; decoding a high frequency band signal using the transformed signal; and inverse-transforming the decoded signal.

According to another aspect of embodiments, there is provided a computer-readable medium having embodied thereon a computer program for executing a method of bandwidth extension encoding, the method comprising: determining whether an input signal will be encoded in a frequency domain and a time domain for each of a plurality of sub-bands; dividing the input signal for each sub-band so that the input signal is transformed to the time domain or the frequency domain according to a determination result of the determining operation; controlling noise of sub-band signals transformed to the frequency domain and performing quantization and lossless encoding; encoding the sub-band signals transformed to the time domain using CELP; encoding a high frequency band signal using the transformed sub-band signals.

According to another aspect of embodiments, there is provided a computer-readable medium having embodied thereon a computer program for executing a method of bandwidth extension decoding, the method comprising: checking whether each of a plurality of sub-band signals has been encoded in a frequency domain or a time domain; losslessly decoding the sub-band signals encoded in the frequency domain, performing de-quantization, and controlling noise; decoding the sub-band signals encoded in the time domain using CELP; transforming the decoded signal to the frequency domain; decoding a high frequency band signal by using the signal containing controlled noise and the transformed signal; and synthesizing the sub-band signals and inverse-transforming the synthesized signal to the time domain.

BRIEF DESCRIPTION OF THE DRAWINGS

These and/or other aspects, features, and advantages will become apparent and more readily appreciated from the following description of exemplary embodiments, taken in conjunction with the accompanying drawings of which.

DETAILED DESCRIPTION OF EMBODIMENTS

Figure 1:
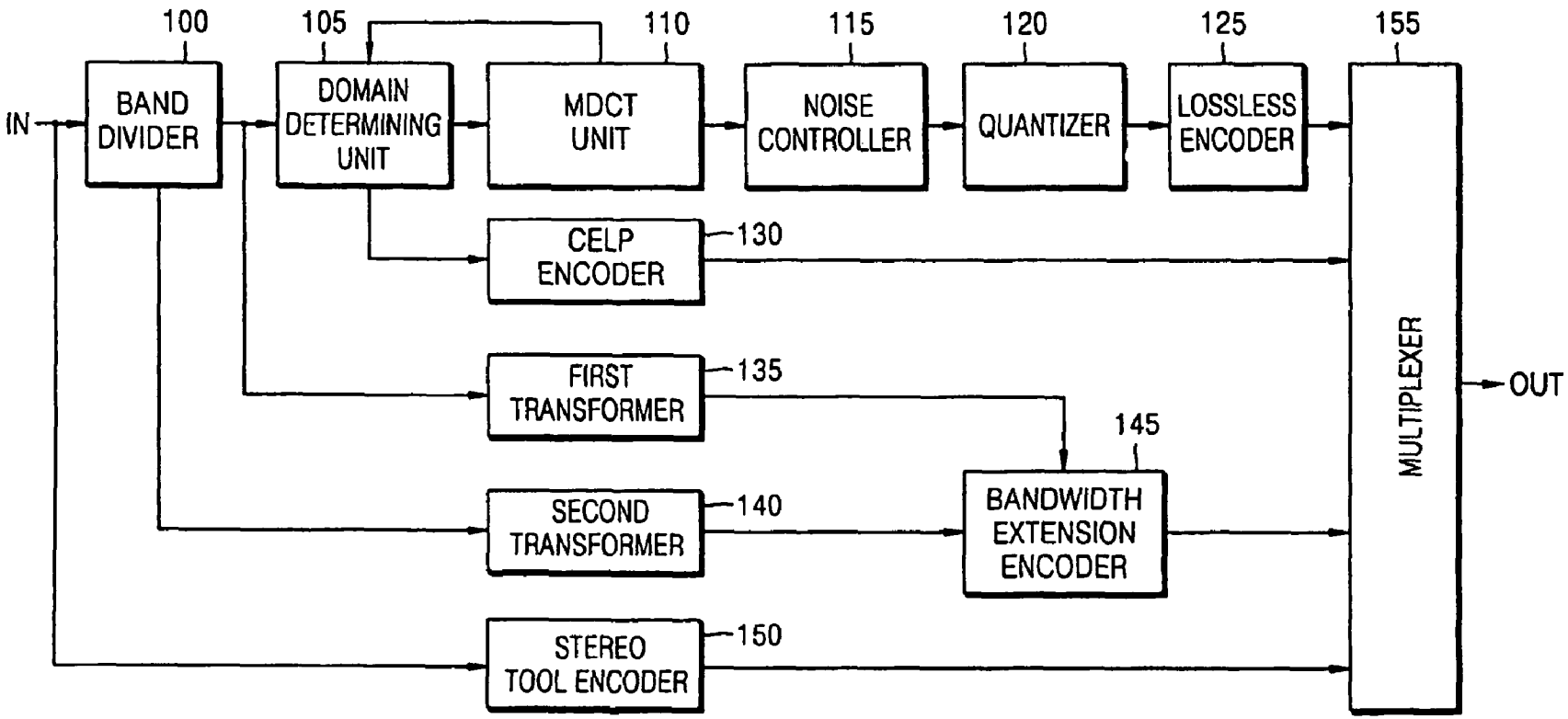
FIG. 1 is a block diagram of an apparatus for bandwidth extension encoding according to an exemplary embodiment.

Reference will now be made in detail to exemplary embodiments, examples of which are illustrated in the accompanying drawings, wherein like reference numerals refer to the like elements throughout. Exemplary embodiments are described below by referring to the figures.

FIG. 1 is a block diagram of an apparatus for bandwidth extension encoding according to an exemplary embodiment. The apparatus includes a band divider 100, a domain determining unit 105, a modified discrete cosine transform (MDCT) unit 110, a noise controller 115, a quantizer 120, a lossless encoder 125, a code excited linear prediction (CELP) encoder 130, a first transformer 135, a second transformer 140, a bandwidth extension encoder 145, a stereo tool encoder 150, and a multiplexer 155.

The band divider 100 divides an input signal received through an input terminal IN into a low frequency band signal and a high frequency band signal.

The domain determining unit 105 determines whether the low frequency band signal output by the band divider 100 will be encoded in the time domain or the frequency domain. When the domain determining unit 105 determines a domain to be used in encoding, either a signal of the time domain output by the band divider 100 or a signal transformed to the frequency domain by the MDCT unit 110 may be used. Alternatively, the signal of the time domain output by the band divider 100 and the signal transformed to the frequency domain by the MDCT unit 110 may both be used.

The MDCT unit 110 transforms the low frequency band signal output by the band divider 100 or the low frequency band signal determined to be encoded in the frequency domain by the domain determining unit 105 from the time domain to the frequency domain using an MDCT method.

In order to reduce quantization noise, the noise controller 115 controls noise so that a temporal envelope of the signal transformed into a frequency band signal by the MDCT unit 110 is constant. The noise controller 115 may use temporal noise shaping (TNS).

The quantizer 120 quantizes a signal containing noise controlled by the noise controller 115.

The lossless encoder 125 losslessly encodes the signal quantized by the quantizer 120. Examples of the frequency domain encoding include advanced audio coding (AAC) and bit sliced arithmetic coding (BSAC).

The CELP encoder 130 encodes the low frequency band signal, which is determined to be encoded in the time domain by the domain determining unit 105, using a CELP method. Encoding performed by the CELP encoder 130 is not limited to the CELP method, and thus another method may be used as long as encoding is performed in the time domain.

The first transformer 135 transforms the low frequency band signal output by the band divider 100 using a transform method other than the MDCT method. The transform method used by the first transformer 135 may be a modified discrete sine transform (MDST) method, a fast Fourier transform (FFT) method, or a quadrature mirror filterbank (QMF) method.

The second transformer 140 transforms the high frequency band signal, which is output by the band divider 100, by using the same transform method as used in the first transformer 135.

The bandwidth extension encoder 145 encodes the high frequency band signal, which is transformed by the second transformer 140, by using the low frequency band signal transformed by the first transformer 135. The bandwidth extension encoder 145 encodes information for generating the high frequency band signal by using the low frequency band signal decoded at a decoding end.

The stereo tool encoder 150 encodes information for generating a stereo signal at the decoding end by analyzing the input signal received through the input terminal IN using a stereo tool.

The multiplexer 155 multiplexes the signal encoded by the lossless encoder 125, the signal encoded by the CELP encoder 130, the signal encoded by the bandwidth extension encoder 145, and the signal encoded by the stereo tool encoder 150, to generate a bit-stream which it outputs through an output terminal OUT.

Figure 2:
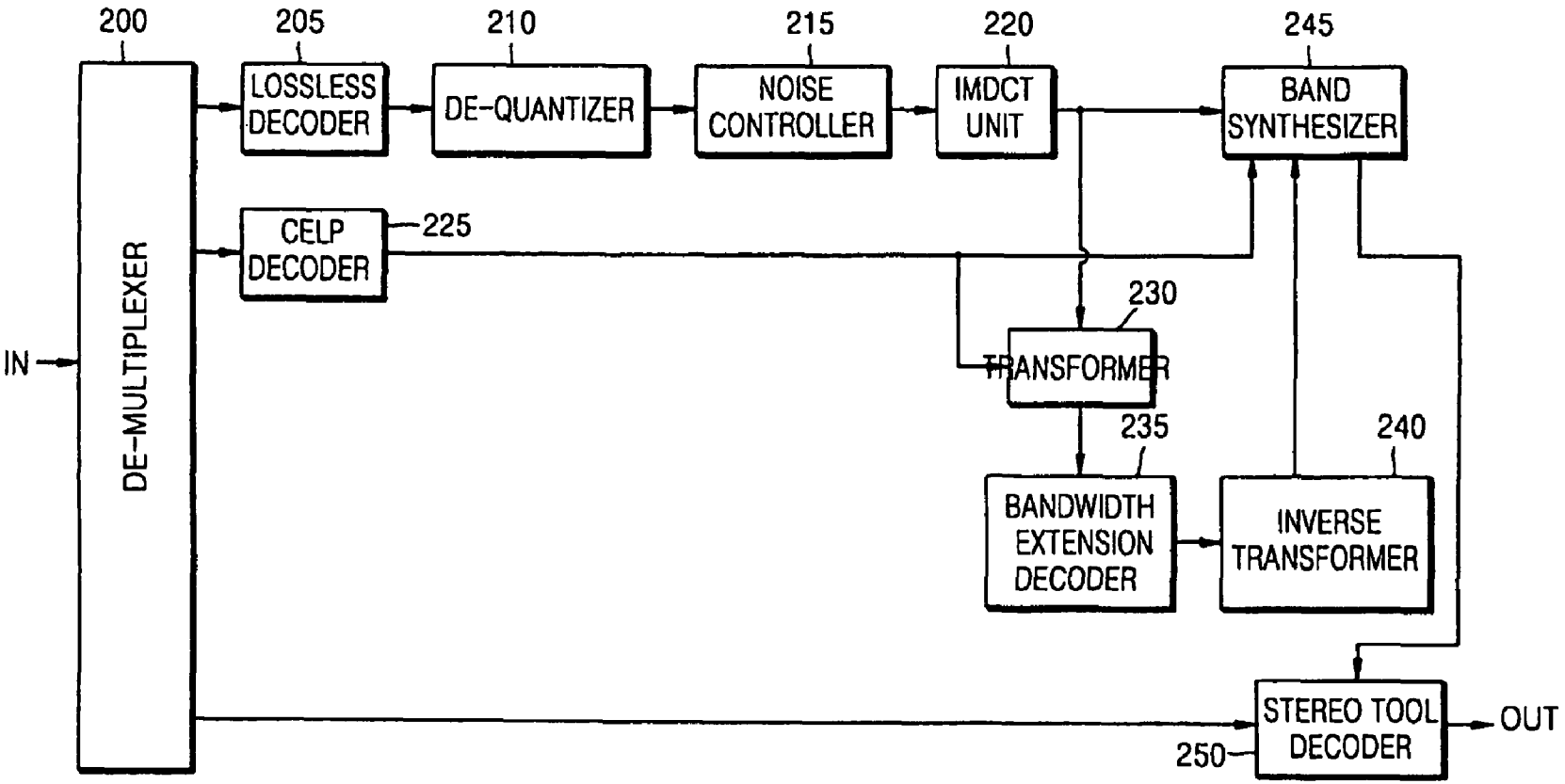
FIG. 2 is a block diagram of an apparatus for bandwidth extension decoding according to an exemplary embodiment.

FIG. 2 is a block diagram of an apparatus for bandwidth extension decoding according to an exemplary embodiment. The apparatus includes a de-multiplexer 200, a lossless decoder 205, a de-quantizer 210, a noise controller 215, an inverse modified discrete cosine transform (IMDCT) unit 220, a CELP decoder 225, a transformer 230, a bandwidth extension decoder 235, an inverse transformer 240, a band synthesizer 245, and a stereo tool decoder 250.

The de-multiplexer 200 receives a bit-stream from an encoding end through an input terminal IN, and de-multiplexes the bit-stream.

The lossless decoder 205 receives the signal, which is losslessly encoded in the frequency domain for the low frequency band signal at the encoding end, from the de-multiplexer 200, and losslessly decodes the received signal. Examples of the frequency domain decoding include AAC and BSAC.

The de-quantizer 210 de-quantizes the signal losslessly decoded by the lossless decoder 205.

In order to reduce quantization noise, the noise controller 215 controls noise so that a temporal envelope of the signal de-quantized by the de-quantizer 210 is constant. The noise controller 215 may use TNS.

The IMDCT unit 220 inverse-transforms a signal containing noise controlled by the noise controller 215 from the frequency domain to the time domain using an IMDCT method.

The CELP decoder 225 receives from the de-multiplexer 200 the signal encoded in the time domain at the encoding end for the low frequency band signal using the CELP method, and decodes the received signal using the CELP method.

The transformer 230 transforms the low frequency band signal inverse-transformed by the IMDCT unit 220 or the low frequency band signal decoded by the CELP decoder 225 using a transform method other than the MDCT method. The transform method used by the transformer 230 may be the MDST method, the FFT method, or the QMF method.

The bandwidth extension decoder 235 receives information for generating the high frequency band signal by using the low frequency band signal, and generates the high frequency band signal by using the low frequency band signal transformed by the transformer 230.

The inverse transformer 240 inverse-transforms the high frequency band signal, which is generated by the bandwidth extension decoder 235, by using an inverse transform method corresponding to the transform used by the transformer 230.

The band synthesizer 245 synthesizes the low frequency band signal inverse-transformed by the IMDCT unit 220 or the low frequency band signal decoded by the CELP decoder 225 and the high frequency band signal inverse-transformed by the inverse transformer 240.

The stereo tool decoder 250 receives information for generating a stereo signal from the de-multiplexer 200, generates the stereo signal from the signal synthesized by the band synthesizer 245 using a stereo tool, and outputs the stereo signal to an output terminal OUT.

Figure 3:
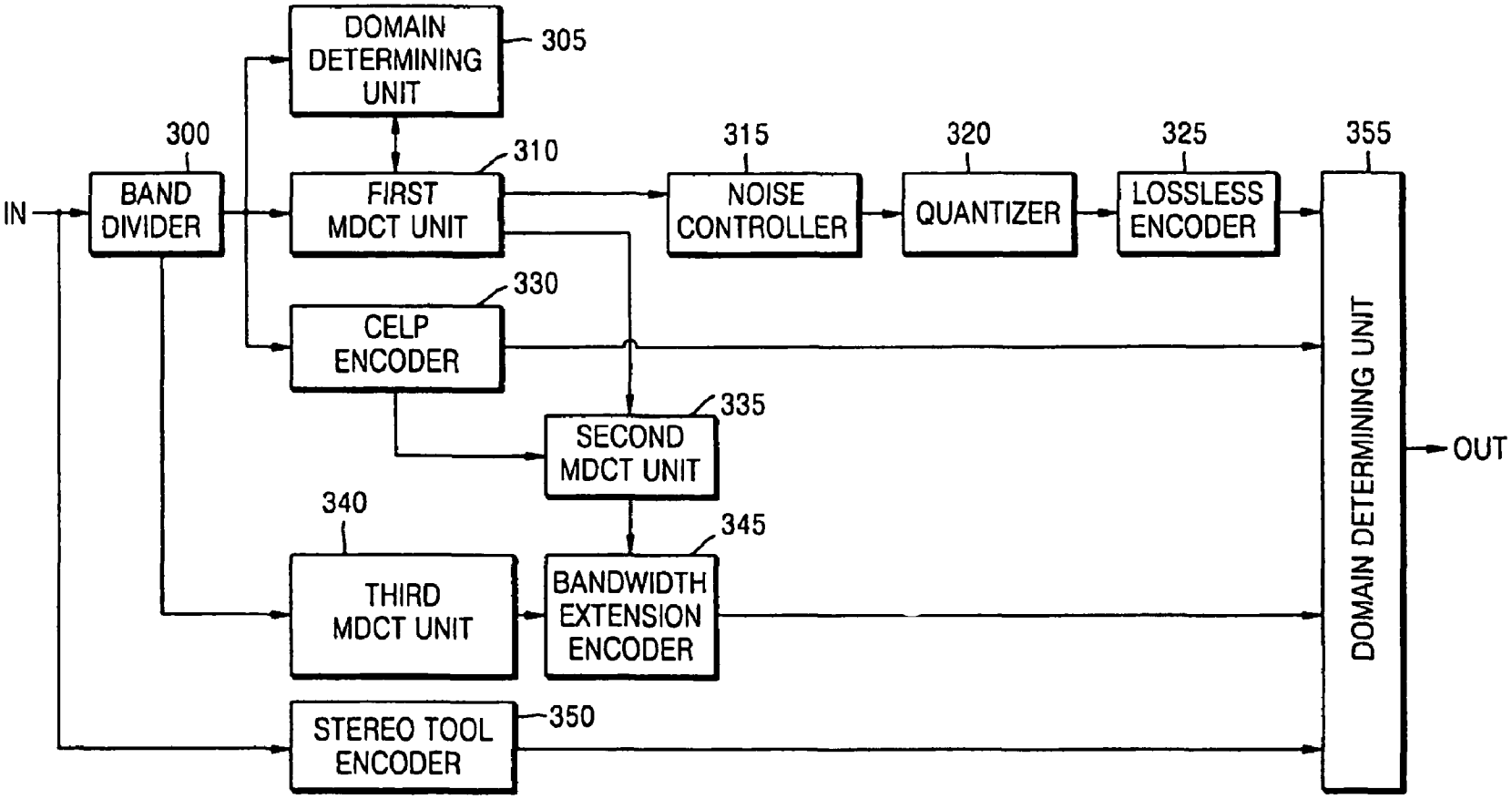
FIG. 3 is a block diagram of an apparatus for bandwidth extension encoding according to another exemplary embodiment.

FIG. 3 is a block diagram of an apparatus for bandwidth extension encoding according to another exemplary embodiment. The apparatus includes a band divider 300, a domain determining unit 305, a first MDCT unit 310, a noise controller 315, a quantizer 320, a lossless encoder 325, a CELP encoder 330, a second MDCT unit 335, a third MDCT unit 340, a bandwidth extension encoder 345, a stereo tool encoder 350, and a multiplexer 355.

The band divider 300 divides an input signal received through an input terminal IN into a low frequency band signal and a high frequency band signal.

The domain determining unit 305 determines whether the low frequency band signal output by the band divider 300 will be encoded in the time domain or the frequency domain. When the domain determining unit 305 determines a domain to be used in encoding, either a signal of the time domain output by the band divider 300 or the signal transformed to the frequency domain by the first MDCT unit 310 may be used. Alternatively, the signal of the time domain output by the band divider 300 and the signal transformed to the frequency domain by the first MDCT unit 310 may both be used.

The first MDCT unit 310 transforms the low frequency band signal output by the band divider 300 or the low frequency band signal determined to be encoded in the frequency domain by the domain determining unit 305 from the time domain to the frequency domain using the MDCT method.

In order to reduce quantization noise, the noise controller 315 controls noise so that a temporal envelope of the signal transformed into a frequency band signal by the first MDCT unit 310 is constant. The noise controller 315 may use TNS.

The quantizer 320 quantizes a signal containing noise controlled by the noise controller 315.

The lossless encoder 325 losslessly encodes the signal quantized by the quantizer 320. Examples of the frequency domain encoding include AAC and BSAC.

The CELP encoder 330 encodes the low frequency band signal, which is determined to be encoded in the time domain by the domain determining unit 305, using the CELP method. Encoding performed by the CELP encoder 330 is not limited to the CELP method, and thus another method may be used as long as encoding is performed in the time domain.

If the domain determining unit 305 determines that the low frequency band signal will be encoded in the time domain, the second MDCT unit 335 transforms the signal encoded by the CELP encoder 330 from the time domain to the frequency domain using the MDCT method.

If the domain determining unit 305 determines that the low frequency band signal will be encoded in the frequency domain, the second MDCT unit 335 does not perform the MDCT but instead outputs the signal transformed by the first MDCT unit 310.

The third MDCT unit 340 transforms the high frequency band signal output by the band divider 300 from the time domain to the frequency domain by using the MDCT method.

The bandwidth extension encoder 345 encodes the high frequency band signal, which is transformed by the third transformer 340, using the low frequency band signal transformed by or output from the second MDCT unit 335. The bandwidth extension encoder 345 encodes information for generating the high frequency band signal by using the low frequency band signal decoded at a decoding end.

The stereo tool encoder 350 encodes information for generating a stereo signal at the decoding end by analyzing an input signal received through the input terminal IN, using a stereo tool.

The multiplexer 355 multiplexes the signal encoded by the lossless encoder 325, the signal encoded by the CELP encoder 330, the signal encoded by the bandwidth extension encoder 345, and the signal encoded by the stereo tool encoder 350, to generate a bit-stream which it outputs through an output terminal OUT.

Figure 4:
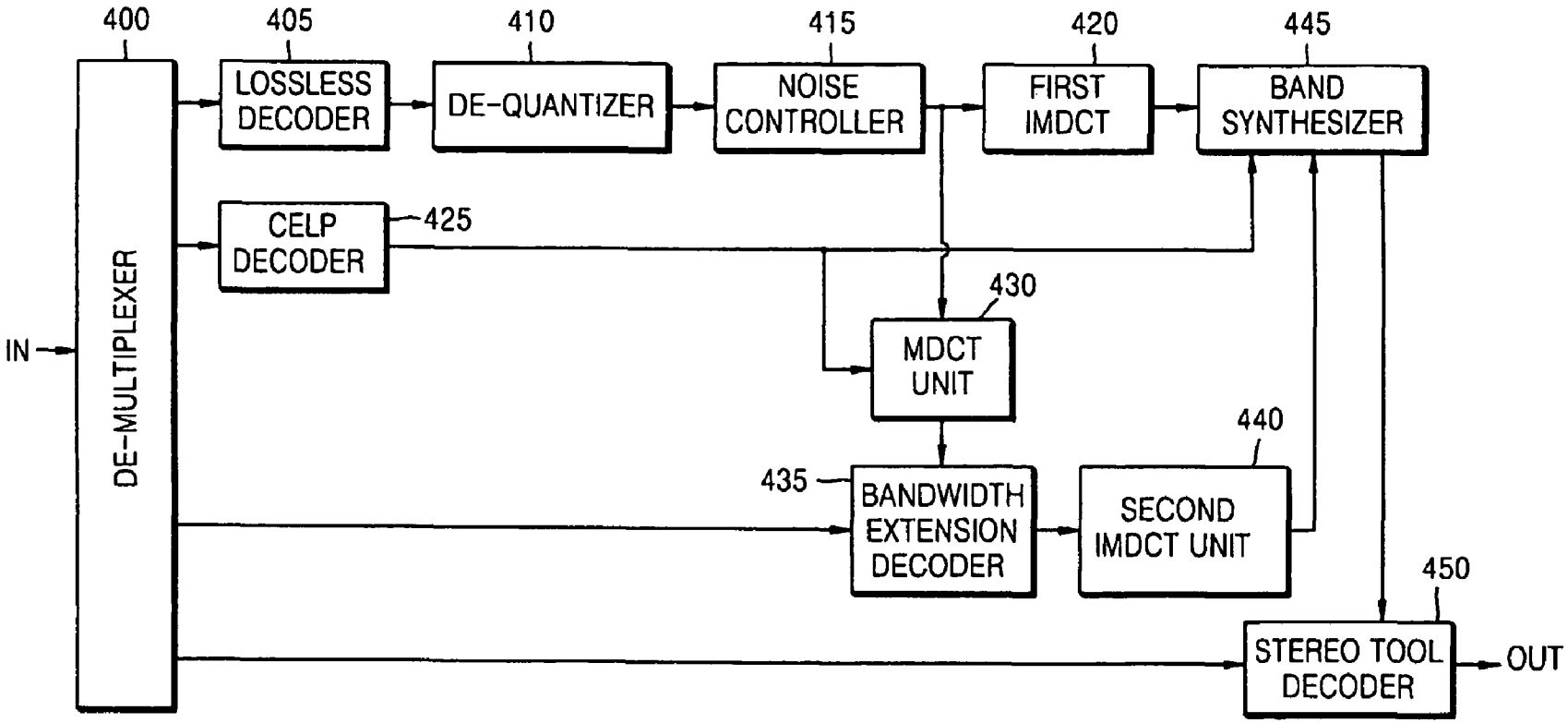
FIG. 4 is a block diagram of an apparatus for bandwidth extension decoding according to another exemplary embodiment.

FIG. 4 is a block diagram of an apparatus for bandwidth extension decoding according to another exemplary embodiment. The apparatus includes a de-multiplexer 400, a lossless decoder 405, a de-quantizer 410, a noise controller 415, a first IMDCT 420, a CELP decoder 425, an MDCT unit 430, a bandwidth extension decoder 435, a second IMDCT unit 440, a band synthesizer 445, and a stereo tool decoder 450.

The de-multiplexer 400 receives a bit-stream from an encoding end through an input terminal IN, and de-multiplexes the bit-stream.

The lossless decoder 405 receives the signal, which is losslessly encoded in the frequency domain for the low frequency band signal at the encoding end, from the de-multiplexer 400, and losslessly decodes the received signal. Examples of the frequency domain decoding include AAC and BSAC.

The de-quantizer 410 de-quantizes the signal losslessly decoded by the lossless decoder 405.

In order to reduce quantization noise, the noise controller 415 controls noise so that a temporal envelope of the signal de-quantized by the de-quantizer 410 is constant. The noise controller 415 may use TNS.

The first IMDCT unit 420 inverse-transforms a signal containing noise controlled by the noise controller 415 using the IMDCT method, from the frequency domain to the time domain.

The CELP decoder 425 receives from the de-multiplexer 400 the signal encoded in the time domain at the encoding end for the low frequency band signal using the CELP method, and decodes the received signal using the CELP method.

If the low frequency band signal is encoded in the time domain, the MDCT unit 430 transforms the signal encoded by the CELP encoder 425 from the time domain to the frequency domain using the MDCT method.

If the low frequency band signal is encoded in the frequency domain, the MDCT unit 430 does not perform the MDCT but instead outputs the signal containing noise controlled by the noise controller 415.

The bandwidth extension decoder 435 receives from the de-multiplexer 400 information for generating the high frequency band signal by using the low frequency band signal, and generates the high frequency band signal by using the low frequency band signal transformed by or output from the MDCT unit 430.

The second IMDCT unit 440 inverse-transforms the high frequency band signal, which is generated by the bandwidth extension decoder 435, using the IMDCT method, from the frequency domain to the time domain.

The band synthesizer 445 synthesizes the low frequency band signal inverse-transformed by the first IMDCT 420 or the low frequency band signal decoded by the CELP decoder 425 and the high frequency band signal inverse-transformed by the second IMDCT unit 440.

The stereo tool decoder 450 receives information for generating a stereo signal from the de-multiplexer 400, generates the stereo signal from the signal synthesized by the band synthesizer 445 using a stereo tool, and outputs the stereo signal to an output terminal OUT.

Figure 5:
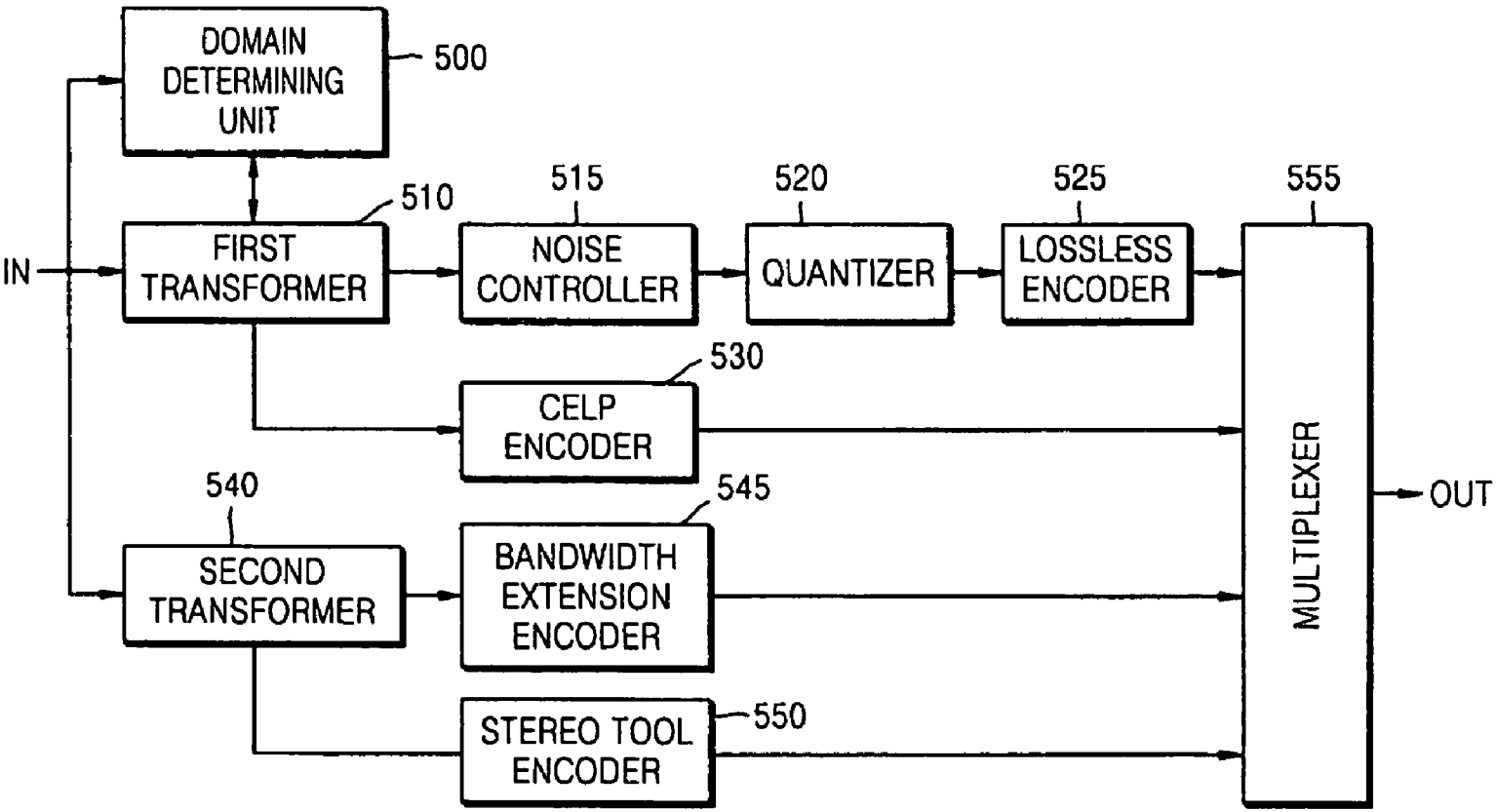
FIG. 5 is a block diagram of an apparatus for bandwidth extension encoding according to another exemplary embodiment.

FIG. 5 is a block diagram of an apparatus for bandwidth extension encoding according to another exemplary embodiment. The apparatus includes a domain determining unit 500, a first transformer 510, a noise controller 515, a quantizer 520, a lossless encoder 525, a CELP encoder 530, a second transformer 540, a bandwidth extension encoder 545, a stereo tool encoder 550, and a multiplexer 555.

The domain determining unit 500 determines whether each sub-band signal will be encoded in the frequency domain or the time domain. When the domain determining unit 500 determines a domain to be used in encoding, either an input signal of the time domain received through an input terminal IN or a signal transformed to the frequency domain or the time domain by the first transformer 510 for each sub-band may be used. Alternatively, the input signal of the time domain received through the input terminal IN and the signal transformed to the frequency domain or the time domain by the first transformer 510 for each sub-band may both be used.

For each sub-band, the first transformer 510 transforms the input signal received through the input terminal IN into a signal of the frequency domain or the time domain. The first transformer 510 may use a frequency varying modulated lapped transform (FV-MLT) method. In this case, the first transformer 510 transforms the input signal into a signal of a domain determined by the domain determining unit 500 for each sub-band, outputs a sub-band signal transformed to the frequency domain to the noise controller 515, and outputs a sub-band signal transformed to the time domain to the CELP encoder 530.

In order to reduce quantization noise, the noise controller 515 controls noise so that a temporal envelope of the sub-band signal transformed into a frequency band signal by the first transformer 510 is constant. The noise controller 515 may use TNS.

The quantizer 520 quantizes a signal containing noise controlled by the noise controller 515.

The lossless encoder 525 losslessly encodes the signal quantized by the quantizer 520. Examples of the frequency domain encoding include AAC and BSAC.

The CELP encoder 530 encodes the low frequency band signal, which is transformed to the time domain by the first transformer 510, using the CELP method. Encoding performed by the CELP encoder 530 is not limited to the CELP method, and thus another method may be used as long as encoding is performed in the time domain.

The second transformer 540 transforms the input signal received through the input terminal IN. The transform method used by the second transformer 530 may be the MDCT method, the MDST method, the FFT method, or the QMF method.

The bandwidth extension encoder 545 encodes the high frequency band signal from the signal, which is transformed to the frequency domain by the second transformer 540, using the low frequency band signal. The bandwidth extension encoder 545 encodes information for generating the high frequency band signal by using the low frequency band signal decoded at a decoding end.

The stereo tool encoder 550 encodes information for generating a stereo signal at the decoding end by analyzing the signal which is transformed to the frequency domain by the second transformer 540, using a stereo tool.

The multiplexer 555 multiplexes the signal encoded by the lossless encoder 525, the signal encoded by the CELP encoder 530, the signal encoded by the bandwidth extension encoder 545, and the signal encoded by the stereo tool encoder 550, to generate a bit-stream which it outputs through an output terminal OUT.

Figure 6:
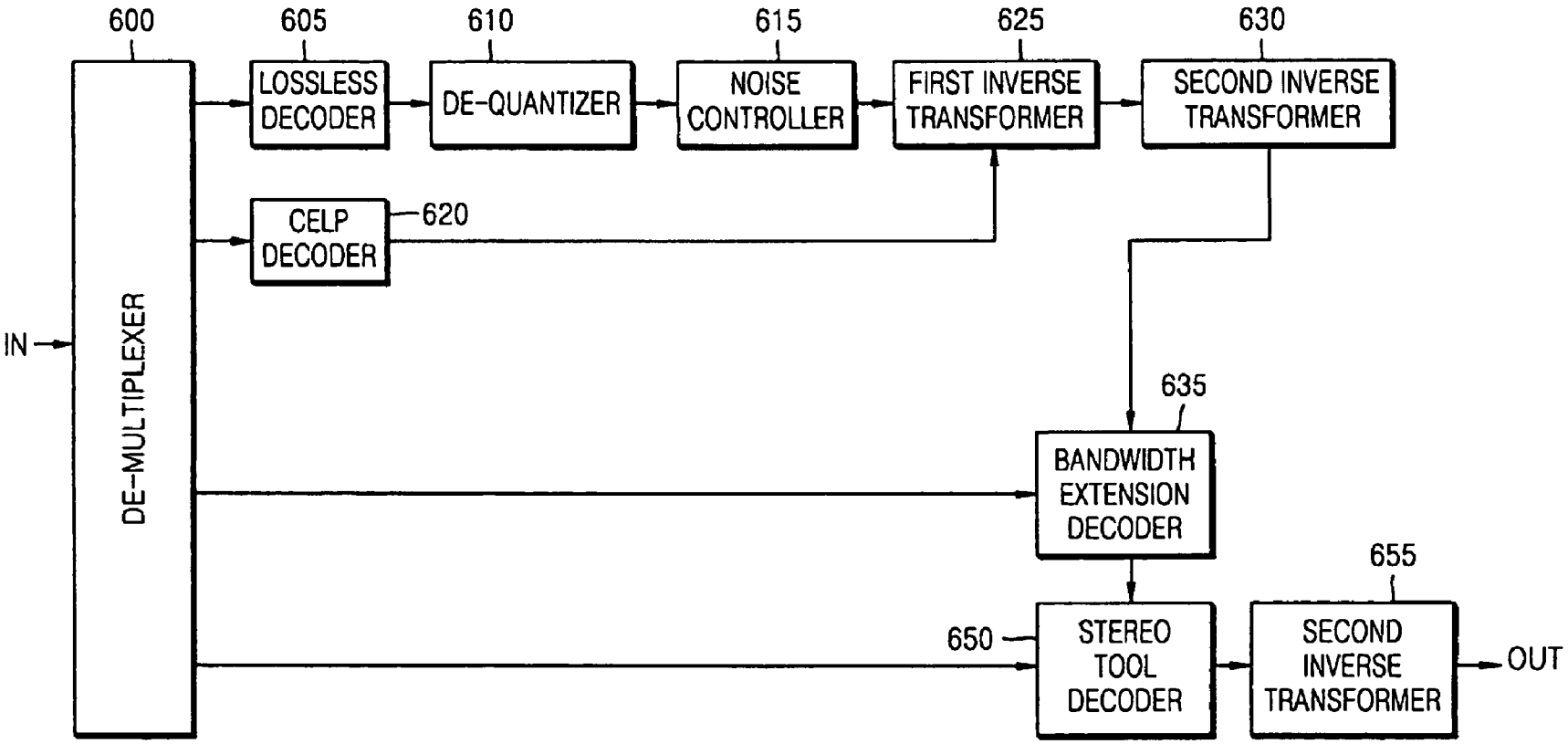
FIG. 6 is a block diagram of an apparatus for bandwidth extension decoding according to another exemplary embodiment.

FIG. 6 is a block diagram of an apparatus for bandwidth extension decoding according to another exemplary embodiment. The apparatus includes a de-multiplexer 600, a lossless decoder 605, a de-quantizer 610, a noise controller 615, a first inverse transformer 625, a CELP decoder 620, a second inverse transformer 630, a bandwidth extension decoder 635, a stereo tool decoder 650, and a second inverse transformer 655.

The de-multiplexer 600 receives a bit-stream from an encoding end through an input terminal IN, and de-multiplexes the bit-stream.

The lossless decoder 605 receives from the de-multiplexer 600 sub-band signals losslessly encoded in the frequency domain at the encoding end, and losslessly decodes the received signals. Examples of the frequency domain decoding include AAC and BSAC.

The de-quantizer 610 de-quantizes the sub-band signals losslessly decoded by the lossless decoder 405.

In order to reduce quantization noise, the noise controller 615 controls noise so that a temporal envelope of each sub-band signal de-quantized by the de-quantizer 610 is constant. The noise controller 615 may use TNS.

The CELP decoder 620 receives from the de-multiplexer 600 the sub-band signals encoded in the time domain at the encoding end using the CELP method, and decodes the received signals using the CELP method.

The first inverse transformer 625 synthesizes the sub-band signals each containing noise controlled by the noise controller 615 and the sub-band signals decoded by the CELP decoder 620, and inverse-transforms the synthesized signal in the time domain. The first inverse transformer 625 may use an inverse FV-MLT method.

The second inverse transformer 630 transforms the signal inverse-transformed by the first inverse transformer 625. The transform method used by the second inverse transformer 630 may be the MDCT method, the MDST method, the FFT method, or the QMF method.

The bandwidth extension decoder 635 receives from the de-multiplexer 600 information for generating the high frequency band signal by using the low frequency band signal, and generates the high frequency band signal by using the signal transformed by the second inverse transformer 630.

The stereo tool decoder 650 receives from the de-multiplexer 600 information for generating a stereo signal, and generates the stereo signal using the stereo tool.

The second inverse transformer 655 inverse-transforms the stereo signal, which is generated by the stereo tool decoder 650, using an inverse transform method corresponding to the transform used by the second inverse transformer 630, and outputs the stereo signal through an output terminal OUT.

Figure 7:
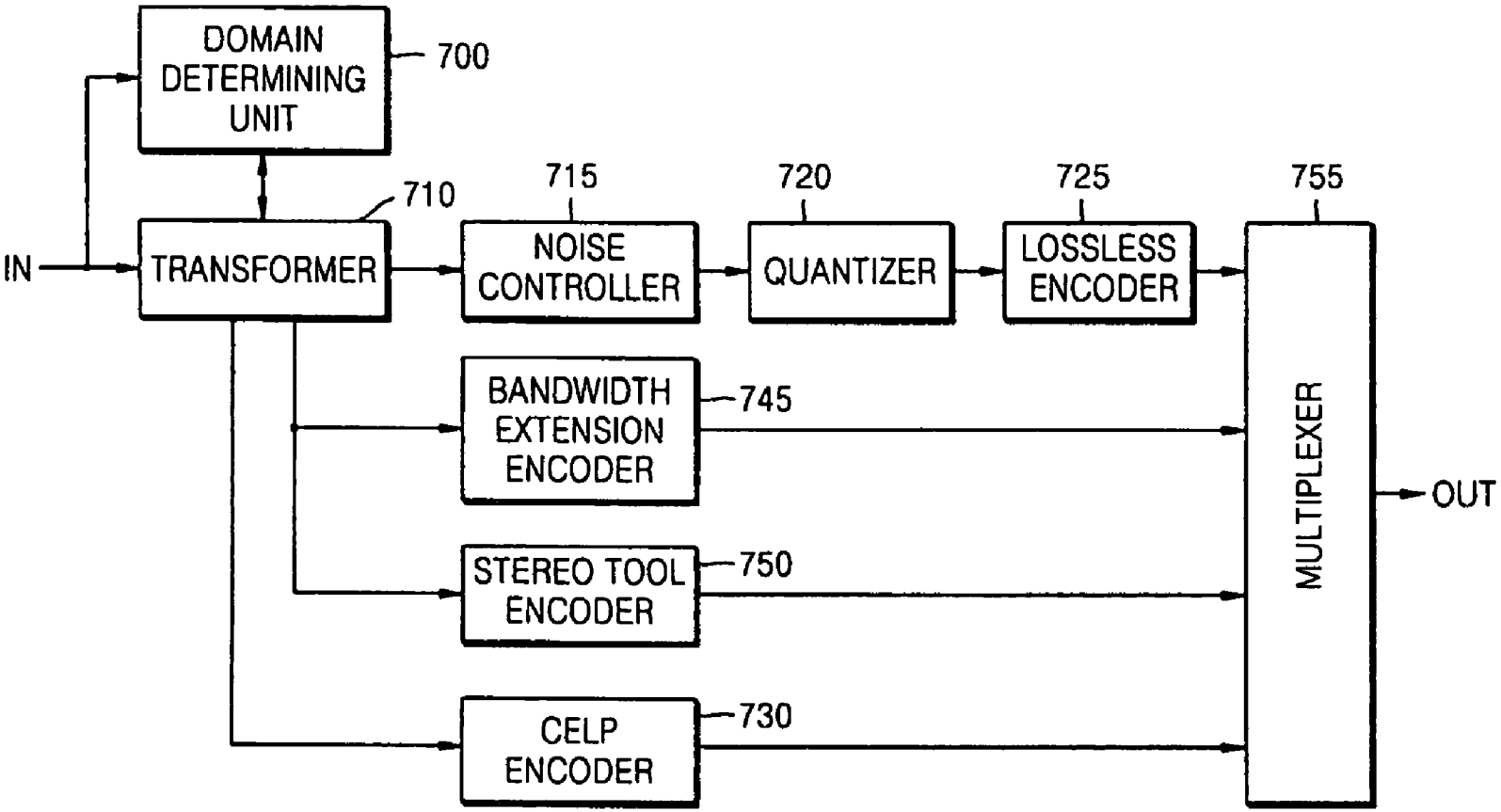
FIG. 7 is a block diagram of an apparatus for bandwidth extension encoding according to another exemplary embodiment.

FIG. 7 is a block diagram of an apparatus for bandwidth extension encoding according to another exemplary embodiment. The apparatus includes a domain determining unit 700, a transformer 710, a noise controller 715, a quantizer 720, a lossless encoder 725, a CELP encoder 730, a bandwidth extension encoder 745, a stereo tool encoder 750, and a multiplexer 755.

The domain determining unit 700 determines whether each sub-band signal will be encoded in the frequency domain or the time domain. When the domain determining unit 700 determines a domain to be used in encoding, either an input signal of the time domain received through an input terminal IN or a signal transformed to the frequency domain or the time domain by the transformer 710 for each sub-band may be used. Alternatively, the input signal of the time domain received through the input terminal IN and the signal transformed to the frequency domain or the time domain by the transformer 710 for each sub-band may both be used.

For each sub-band, the transformer 710 transforms the input signal received through the input terminal IN into a signal of the frequency domain or the time domain. The transformer 710 may use the FV-MLT method. In this case, the transformer 710 transforms the input signal into a signal of a domain determined by the domain determining unit 700 for each sub-band, outputs a sub-band signal transformed to the frequency domain to the noise controller 715, and outputs a sub-band signal transformed to the time domain to the CELP encoder 730.

In order to reduce quantization noise, the noise controller 715 controls noise so that a temporal envelope of each sub-band signal transformed into a frequency band signal by the transformer 710 is constant. The noise controller 715 may use TNS.

The quantizer 720 quantizes a signal containing noise controlled by the noise controller 715.

The lossless encoder 725 losslessly encodes the signal quantized by the quantizer 720. Examples of the frequency domain encoding include AAC and BSAC.

The CELP encoder 730 encodes a low frequency band signal, which is transformed to the time domain by the transformer 710, using the CELP method. Encoding performed by the CELP encoder 730 is not limited to the CELP method, and thus another method may be used as long as encoding is performed in the time domain.

The bandwidth extension encoder 745 encodes the high frequency band signal from the signal, which is transformed to the time domain or the frequency domain by the transformer 710 for each sub-band, using the low frequency band signal. The bandwidth extension encoder 745 encodes information for generating the high frequency band signal using the low frequency band signal decoded at a decoding end.

The stereo tool encoder 750 encodes information for generating a stereo signal at the decoding end by analyzing the signal which is transformed to the time domain or the frequency domain by the transformer 710 for each sub-band, using a stereo tool.

The multiplexer 755 multiplexes the signal encoded by the lossless encoder 725, the signal encoded by the CELP encoder 730, the signal encoded by the bandwidth extension encoder 745, and the signal encoded by the stereo tool encoder 750, to generate a bit-stream which it outputs through an output terminal OUT.

Figure 8:
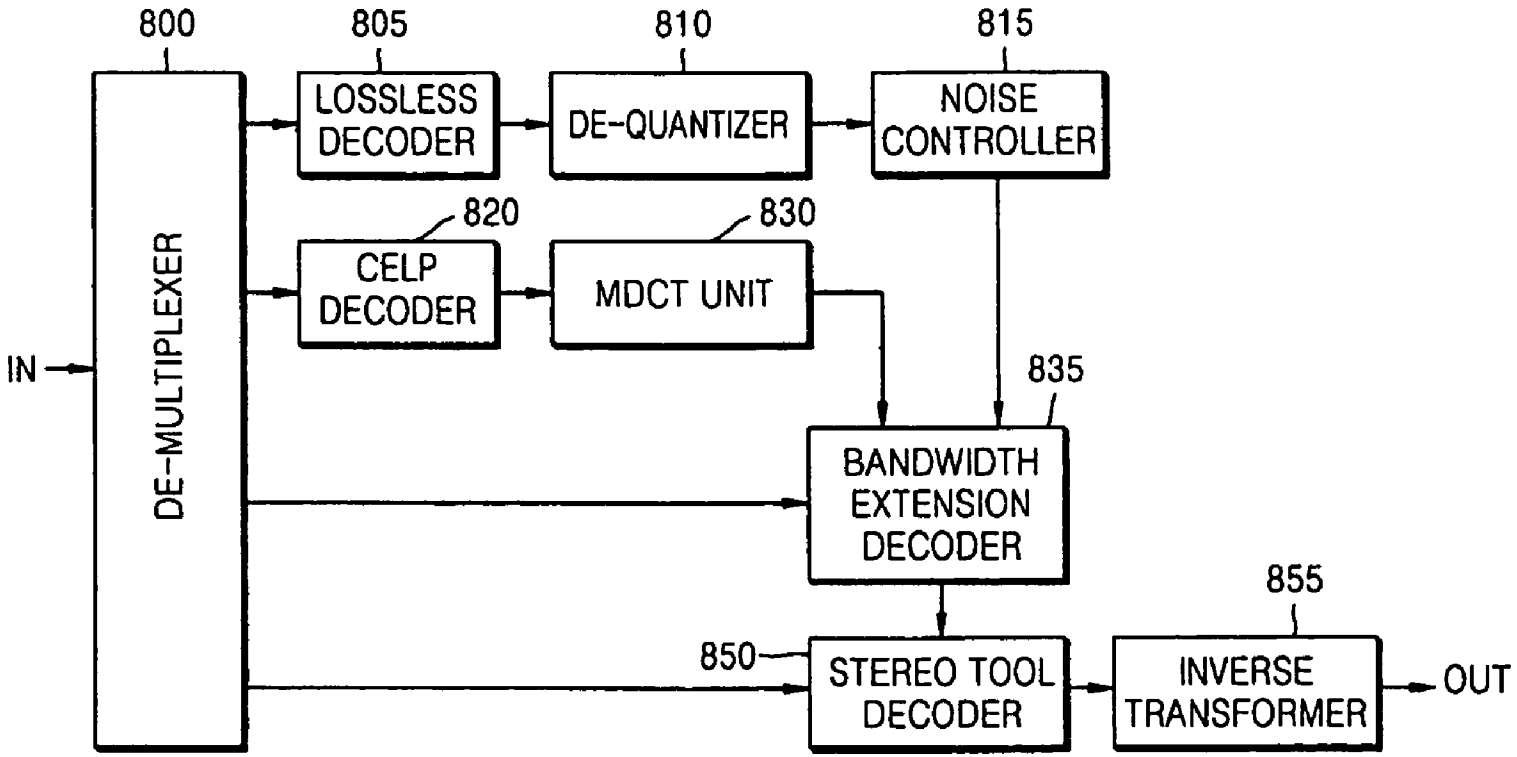
FIG. 8 is a block diagram of an apparatus for bandwidth extension decoding according to another exemplary embodiment.

FIG. 8 is a block diagram of an apparatus for bandwidth extension decoding according to another exemplary embodiment. The apparatus includes a de-multiplexer 800, a lossless decoder 805, a de-quantizer 810, a noise controller 815, a CELP decoder 820, an MDCT unit 830, a bandwidth extension decoder 835, a stereo tool decoder 850, and an inverse transformer 855.

The de-multiplexer 800 receives a bit-stream from an encoding end through an input terminal IN, and de-multiplexes the bit-stream.

The lossless decoder 805 receives from the de-multiplexer 800 sub-band signals losslessly encoded in the frequency domain at the encoding end, and losslessly decodes the received signals. Examples of the frequency domain decoding include AAC and BSAC.

The de-quantizer 810 de-quantizes the sub-band signals losslessly decoded by the lossless decoder 805.

In order to reduce quantization noise, the noise controller 815 controls noise so that a temporal envelope of each sub-band signal de-quantized by the de-quantizer 810 is constant. The noise controller 815 may use TNS.

The CELP decoder 820 receives from the de-multiplexer 800 the sub-band signals, which are encoded in the time domain at the encoding end using the CELP method, and decodes the received signal using the CELP method.

The MDCT unit 830 transforms the low frequency band signal from the time domain to the frequency domain by performing the MDCT on the signals decoded by the CELP decoder 820.

The bandwidth extension decoder 635 receives from the de-multiplexer 600 information for generating the high frequency band signal by using the low frequency band signal, and generates the high frequency band signal by using the signal containing noise controlled by the noise controller 815 or the signal transformed by the MDCT unit 830.

The stereo tool decoder 850 receives information for generating a stereo signal from the de-multiplexer 800, and generates the stereo signal using the stereo tool.

The inverse transformer 855 synthesizes the sub-band signals generated as stereo signals by the stereo tool decoder 850 and inverse-transforms the signals in the time domain. The inverse transformer 855 may use the inverse FV-MLT method.

Figure 9:
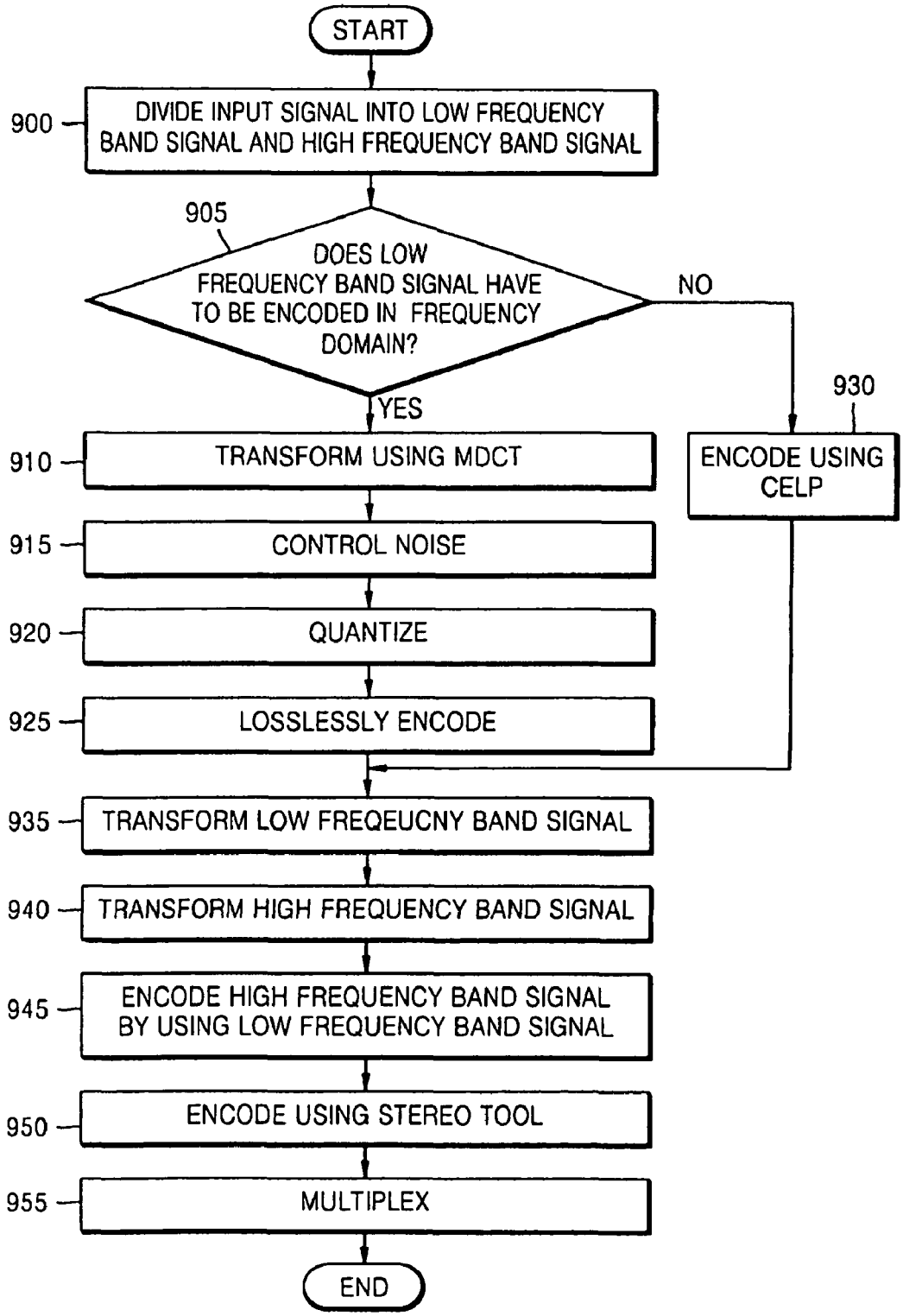
FIG. 9 is a flowchart illustrating a method of bandwidth extension encoding according to an exemplary embodiment.

FIG. 9 is a flowchart illustrating a method of bandwidth extension encoding according to an exemplary embodiment.

First, an input signal is divided into a low frequency band signal and a high frequency band signal (operation 900).

It is determined whether the low frequency band signal generated in operation 900 will be encoded in the time domain or the frequency domain (operation 905). When a domain to be used in encoding is determined in operation 905, as shown in FIG. 9, only a signal of the time domain generated in operation 900 may be used. On the other hand, the low frequency band signal may be transformed from the time domain to the frequency domain by performing the MDCT on the signal of the time domain generated in operation 900, and then the signal transformed to the frequency domain may be used. Alternatively, the signal of the time domain generated in operation 900 and the signal transformed to the frequency domain may both be used.

If the determination result of operation 905 shows that the low frequency band signal generated in operation 900 will be encoded in the frequency domain, the low frequency band signal generated in operation 900 is transformed from the time domain to the frequency domain using the MDCT method (operation 910).

In order to reduce quantization noise, noise is controlled so that a temporal envelope of the signal transformed into a frequency band signal in operation 910 is constant (operation 915). A TNS operation may be performed in operation 915.

The signal containing noise controlled in operation 915 is quantized (operation 920).

The signal quantized in operation 920 is losslessly encoded (operation 925). Examples of the frequency domain encoding include AAC and BSAC.

A low frequency band signal determined to be encoded in the time domain in operation 905 is encoded using the CELP method (operation 930). Encoding performed in operation 930 is not limited to the CELP method, and thus another method may be used as long as encoding is performed in the time domain.

The low frequency band signal generated in operation 900 is transformed using a transform method other than the MDCT method (operation 935). The transform method used in operation 935 may be the MDST method, the FFT method, or the QMF method.

The high frequency band signal generated in operation 900 is transformed by using the same transform method as used in operation 935 (operation 940).

The high frequency band signal transformed in operation 935 is encoded by using the low frequency band signal transformed in operation 940 (operation 935). In operation 945, information for generating the high frequency band signal is encoded by using the low frequency band signal to be decoded at a decoding end.

After operation 945, the input signal is analyzed using the stereo tool, and information for generating a stereo signal is encoded at the decoding terminal (operation 950).

The signal encoded in operation 925, the signal encoded in operation 930, the signal encoded in operation 945, and the signal encoded in operation 950 are multiplexed to generate a bit-stream (operation 955).

Figure 10:
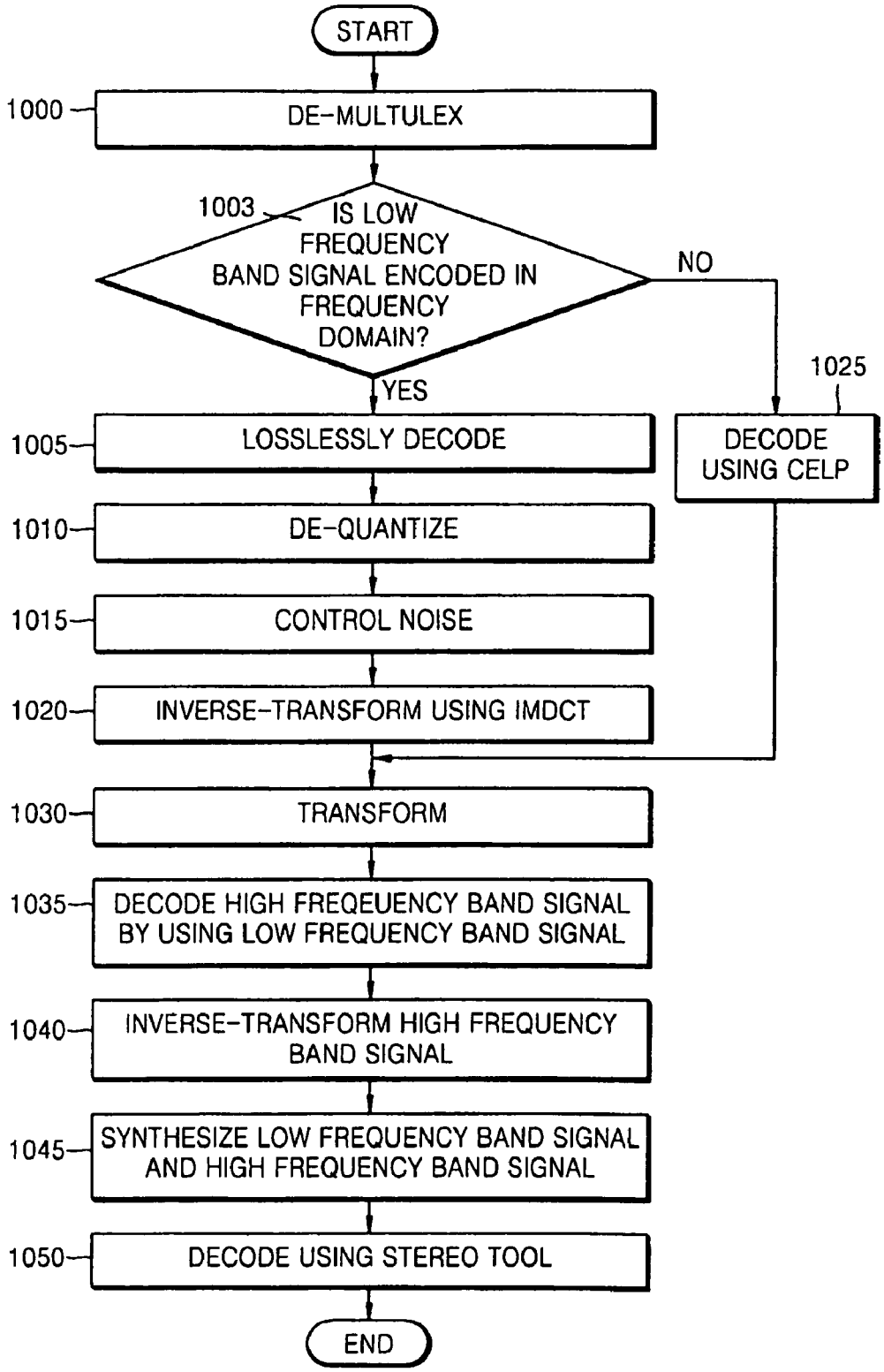
FIG. 10 is a flowchart illustrating a method of bandwidth extension decoding according to an exemplary embodiment.

FIG. 10 is a flowchart illustrating a method of bandwidth extension decoding according to an exemplary embodiment.

First, a bit-stream is received from an encoding end and de-multiplexed (operation 1000).

It is then determined whether the low frequency band signal was encoded in the frequency domain or the time domain at the encoding end (operation 1003).

If the determination result of operation 1003 shows that the low frequency band signal was encoded in the frequency domain at the encoding end, a signal losslessly encoded in the frequency domain at the encoding end for the low frequency band signal is received and losslessly decoded (operation 1005). Examples of the frequency domain decoding include AAC and BSAC.

The signal losslessly decoded in operation 1005 is de-quantized (operation 1010).

In order to reduce quantization noise, noise is controlled so that a temporal envelope of the signal de-quantized in operation 1010 is constant (operation 1015). A TNS operation may be performed in operation 1015.

The signal containing noise controlled in operation 1015 using the IMDCT method is inverse-transformed from the frequency domain to the time domain (operation 1020).

If the determination result of operation 1003 shows that the low frequency band signal at the encoding end was encoded in the time domain, the signal encoded in the time domain at the encoding end for the low frequency band signal is received and then decoded using the CELP method (operation 1025).

The low frequency band signal inverse-transformed in operation 1020 or the low frequency band signal decoded in operation 1025 is transformed using a transform method other than the MDCT method (operation 1030). The transform method used in operation 1030 may be the MDST method, the FFT method, or the QMF method.

Information for generating the high frequency band signal by using the low frequency band signal is received, and the high frequency band signal is generated by using the low frequency band signal transformed in operation 1030 (operation 1035).

The high frequency band signal generated in operation 1035 is inverse-transformed using an inverse transform method corresponding to the transform of operation 1030 (operation 1040).

The low frequency band signal inverse-transformed in operation 1020 or the low frequency band signal decoded in operation 1025 and the high frequency band signal inverse-transformed in operation 1040 are synthesized (operation 1045).

Information for generating a stereo signal is received, and the stereo signal is generated using the stereo tool from the signal synthesized in operation 1045 (operation 1050).

Figure 11:
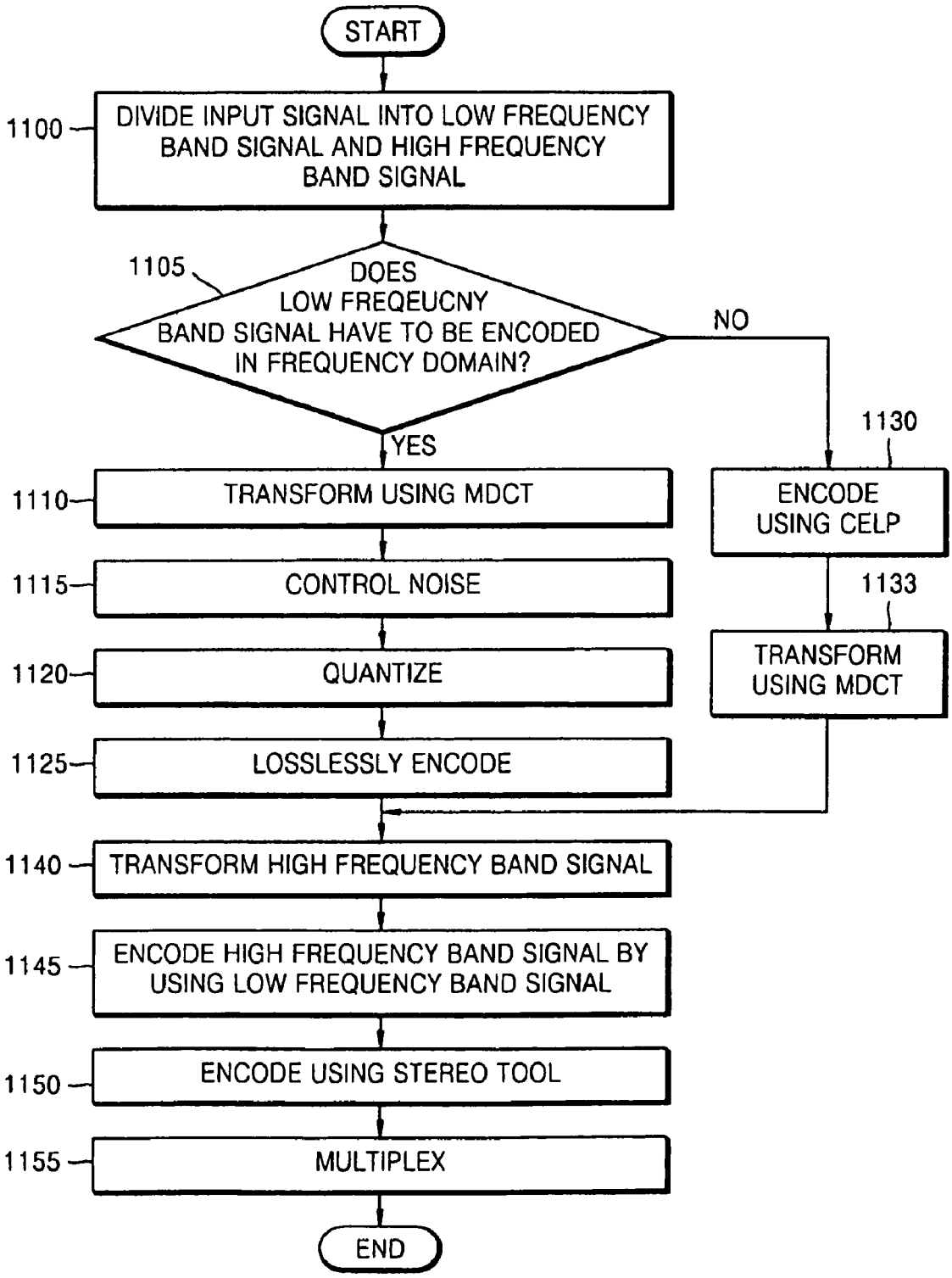
FIG. 11 is a flowchart illustrating a method of bandwidth extension encoding according to another exemplary embodiment.

FIG. 11 is a flowchart illustrating a method of bandwidth extension encoding according to another exemplary embodiment.

First, an input signal is divided into a low frequency band signal and a high frequency band signal (operation 1100).

It is then determined whether the low frequency band signal generated in operation 1100 will be encoded in the time domain or the frequency domain (operation 1105). When a domain to be used in encoding is determined in operation 1105, as shown in FIG. 11, only a signal of the time domain generated in operation 1100 may be used. On the other hand, the low frequency band signal may be transformed from the time domain to the frequency domain by performing the MDCT on the signal of the time domain generated in operation 1100, and then the signal transformed to the frequency domain may be used. Alternatively, the signal of the time domain generated in operation 1100 and the signal transformed to the frequency domain may both be used.

If the determination result of operation 1105 shows that the low frequency band signal generated in operation 1100 will be encoded in the frequency domain, the low frequency band signal generated in operation 1100 undergoes MDCT so that the low frequency band signal can be transformed from the time domain to the frequency domain (operation 1110).

In order to reduce quantization noise, noise is controlled so that a temporal envelope of the signal transformed into a frequency band signal in operation 1110 is constant (operation 1115). A TNS operation may be performed in operation 1115.

The signal containing noise controlled in operation 1115 is quantized (operation 1120).

The signal quantized in operation 1120 is losslessly encoded (operation 1125). Examples of the frequency domain encoding include AAC and BSAC.

If the determination result of operation 1105 shows that the low frequency band signal generated in operation 1100 will be encoded in the time domain, the low frequency band signal generated in operation 1100 is encoded using the CELP method (operation 1130). Encoding performed in operation 1130 is not limited to the CELP method, and thus another method may be used as long as encoding is performed in the time domain.

The signal encoded in operation 1130 is transformed from the time domain to the frequency domain using the MDCT method (operation 1133).

The high frequency band signal generated in operation 1100 is transformed from the time domain to the frequency domain using the MDCT method (operation 1140).

The high frequency band signal transformed in operation 1140 is encoded by using the low frequency band signal transformed in operation 1110 or operation 1135 (operation 1145). In operation 1145, information for generating the high frequency band signal is encoded by using the low frequency band signal to be decoded at a decoding end.

The input signal is analyzed using the stereo tool, and information for generating a stereo signal is encoded at the decoding terminal (operation 1150).

The signal encoded in operation 1125, the signal encoded in operation 1130, the signal encoded in operation 1145, and the signal encoded in operation 1150 are multiplexed to generate a bit-stream (operation 1155).

Figure 12:
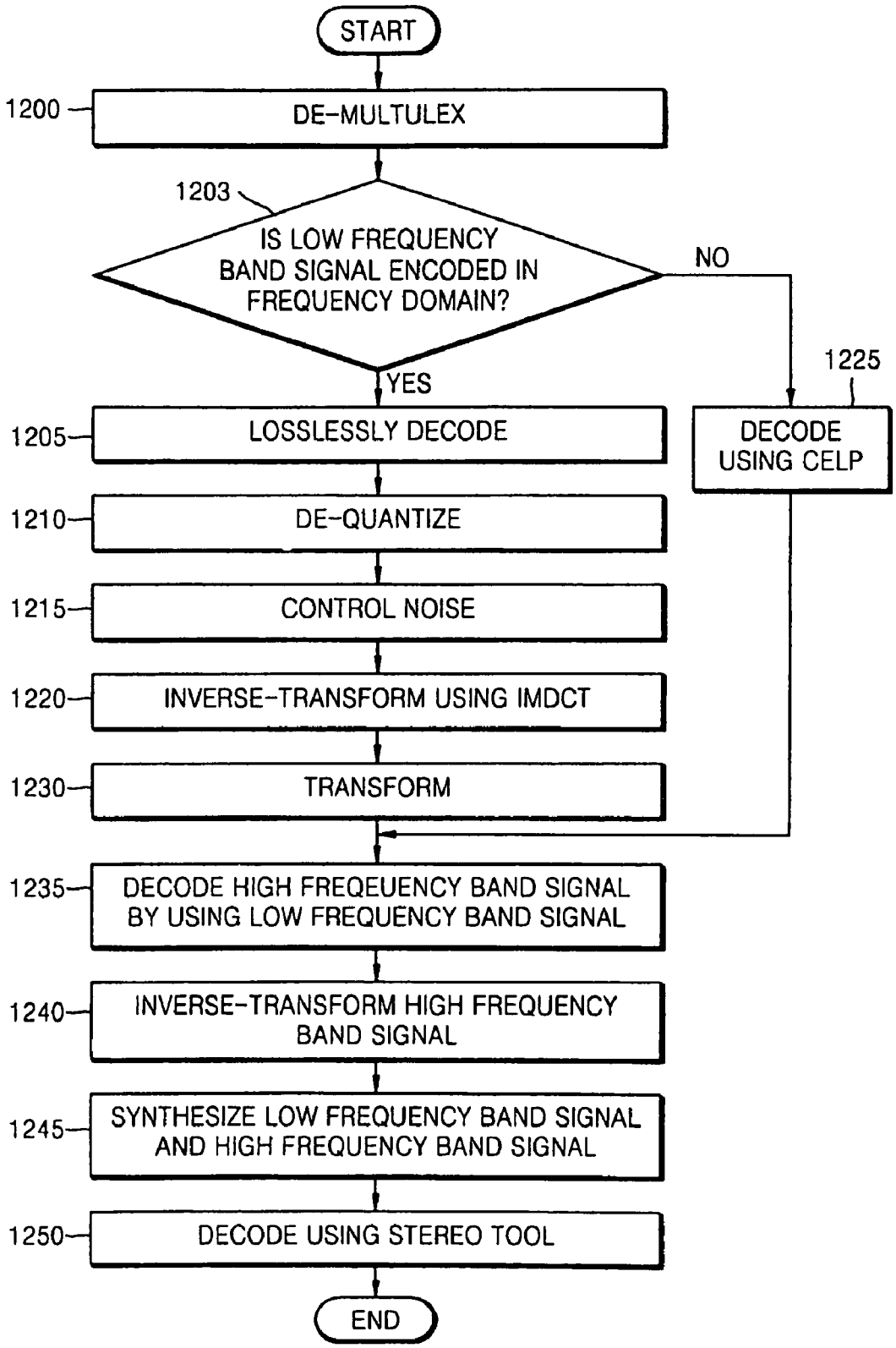
FIG. 12 is a flowchart illustrating a method of bandwidth extension decoding according to another exemplary embodiment.

FIG. 12 is a flowchart illustrating a method of bandwidth extension decoding according to another exemplary embodiment.

First, a bit-stream is received from an encoding end and de-multiplexed (operation 1200).

It is then determined whether a low frequency band signal was encoded in the frequency domain or the time domain at the encoding end (operation 1203).

If the determination result of operation 1203 shows that the low frequency band signal was encoded in the frequency domain at the encoding end, a signal losslessly encoded in the frequency domain at the encoding end for the low frequency band signal is received and losslessly decoded (operation 1205). Examples of the frequency domain decoding include AAC and BSAC.

The signal losslessly decoded in operation 1205 is de-quantized (operation 1210).

In order to reduce quantization noise, noise is controlled so that a temporal envelope of the signal de-quantized in operation 1210 is constant (operation 1215). A TNS operation may be performed in operation 1215.

The signal containing noise controlled in operation 1215 using the IMDCT method is inverse-transformed from the frequency domain to the time domain (operation 1220).

If the determination result of operation 1203 shows that the low frequency band signal at the encoding end was encoded in the time domain, the signal encoded in the time domain at the encoding end for the low frequency band signal is received and then decoded using the CELP method (operation 1225).

The signal decoded in operation 1225 is transformed from the time domain to the frequency domain using the MDCT method (operation 1230).

If the low frequency band signal was encoded in the frequency domain, instead of performing the MDCT, the signal containing controlled noise is output.

Information for generating the high frequency band signal by using the low frequency band signal is received, and the high frequency band signal is generated by using the low frequency band signal containing noise controlled in operation 1215 or the low frequency band signal transformed in operation 1230 (operation 1235).

The high frequency band signal generated in operation 1235 is inverse-transformed from the frequency domain to the time domain using the IMDCT (operation 1240).

The low frequency band signal inverse-transformed in operation 1220 or the low frequency band signal decoded in operation 1225 and the high frequency band signal inverse-transformed in operation 1240 are synthesized (operation 1245).

Information for generating a stereo signal is received, and the stereo signal is generated from the signal synthesized in operation 1245 using the stereo tool (operation 1250).

Figure 13:
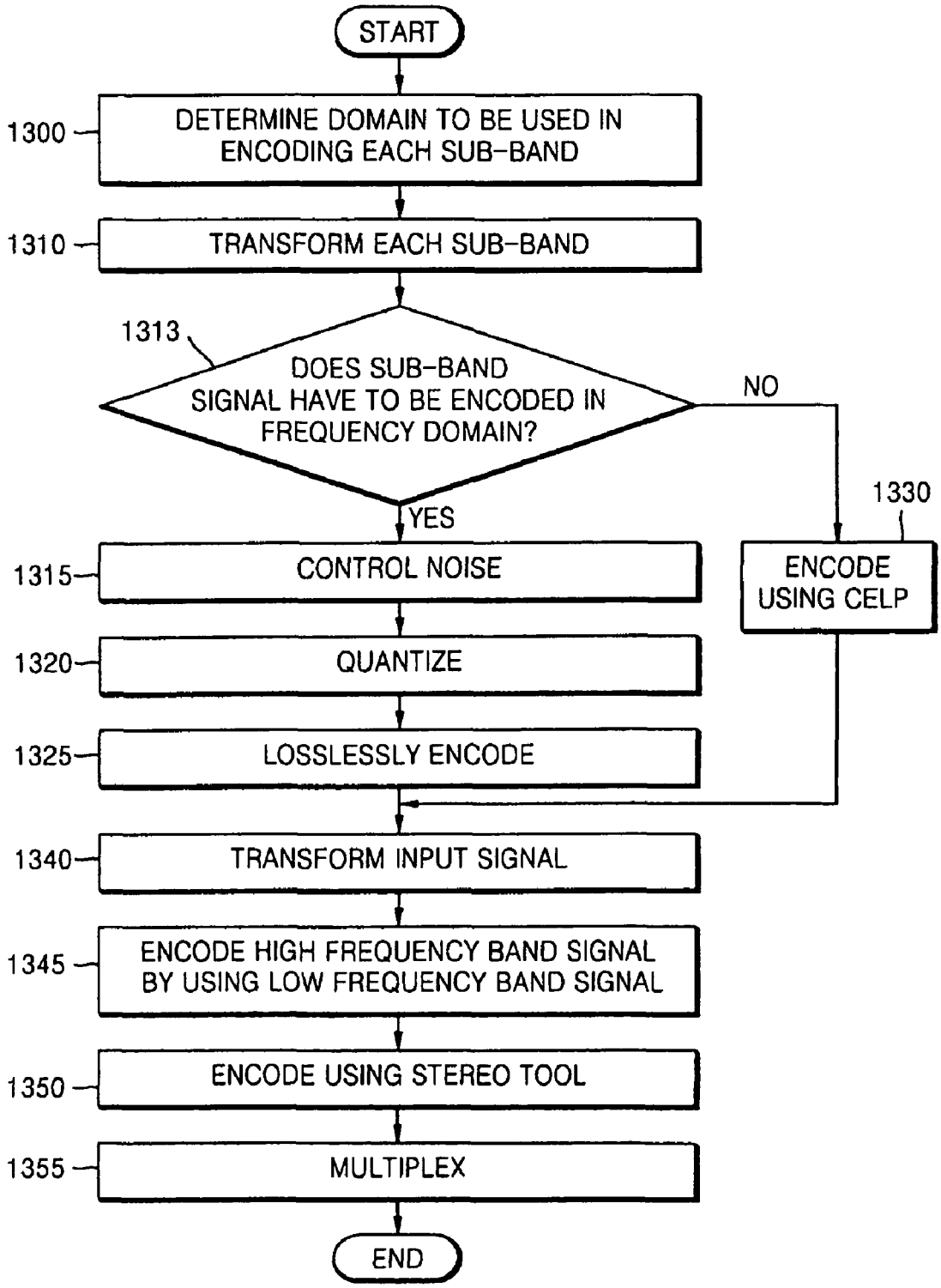
FIG. 13 is a flowchart illustrating a method of bandwidth extension encoding according to another exemplary embodiment.

FIG. 13 is a flowchart illustrating a method of bandwidth extension encoding according to another exemplary embodiment.

First, it is determined whether each sub-band signal will be encoded in the frequency domain or the time domain (operation 1300). When a domain to be used in encoding is determined in operation 1300, as shown in FIG. 13, only an input signal of the time domain may be used. On the other hand, the input signal may be transformed to the frequency domain or the time domain for each of a plurality of sub-bands, and then signals transformed for each sub-band may be used. Alternatively, the input signal and the signals transformed for each sub-band may all be used.

For each sub-band, the input signal is transformed to the frequency domain or the time domain determined for each sub-band in operation 1300 (operation 1310). In operation 1310, the FV-MLT method may be used.

It is then determined whether each sub-band signal is transformed to the frequency domain or the time domain in operation 1310 (operation 1313).

If the determination result of operation 1313 shows that each sub-band signal is transformed to the frequency domain, in order to reduce quantization noise, noise is controlled so that a temporal envelope of the each sub-band signal transformed to the frequency domain in operation 1310 is constant (operation 1315). A TNS operation may be performed in operation 1315.

The signal containing noise controlled in operation 1315 is quantized (operation 1320).

The signal quantized in operation 1320 is losslessly encoded (operation 1325). Examples of the frequency domain encoding include AAC and BSAC.

If the determination result of operation 1313 shows that each sub-band signal is transformed to the time domain, the sub-band signals transformed to the time domain in operation 1310 are encoded using the CELP method (operation 1330). Encoding performed in operation 1330 is not limited to the CELP method, and thus another method may be used as long as encoding is performed in the time domain.

After operation 1330, the input signal is transformed (operation 1340). The transform method used in operation 1340 may be the MDCT method, the MDST method, the FFT method, or the QMF method.

The high frequency band signal is encoded by using the low frequency band signal from the signal which is transformed to the frequency domain in operation 1340 (operation 1345). In operation 1345, information for generating the high frequency band signal is encoded by using the low frequency band signal to be decoded at a decoding end.

The signal transformed to the frequency domain in operation 1340 is analyzed using the stereo tool, and information for generating a stereo signal at the decoding end is encoded (operation 1350).

The signal encoded in operation 1325, the signal encoded in operation 1330, the signal encoded in operation 1345, and the signal encoded in operation 1350 are multiplexed to generate a bit-stream (operation 1355).

Figure 14:
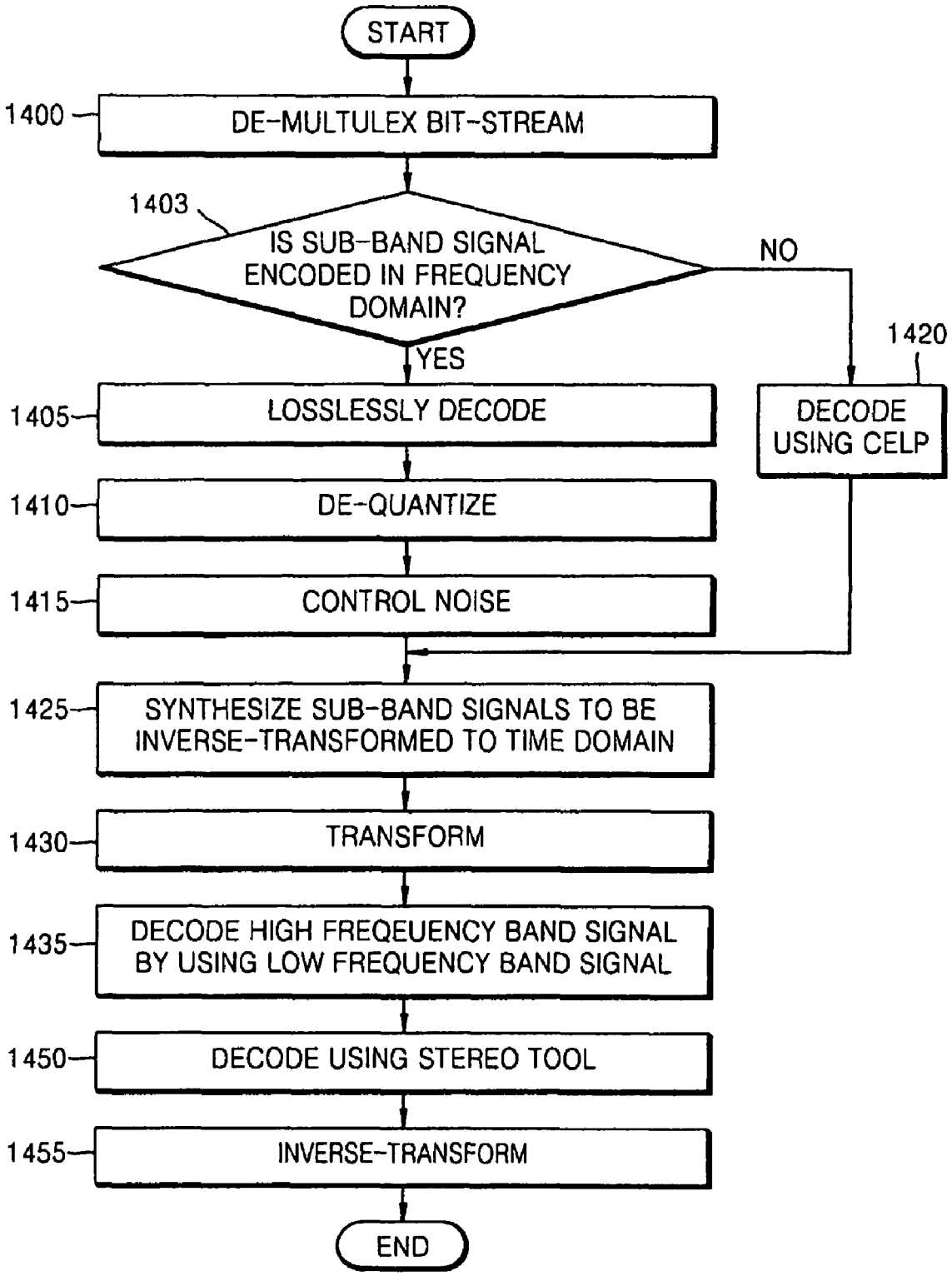
FIG. 14 is a flowchart illustrating a method of bandwidth extension decoding according to another exemplary embodiment.

FIG. 14 is a flowchart illustrating a method of bandwidth extension decoding according to another exemplary embodiment.

First, a bit-stream is received from an encoding end and de-multiplexed (operation 1400).

After operation 1400, it is determined whether each sub-band signal was encoded in the frequency domain or the time domain at the encoding end (operation 1403).

If the determination result of operation 1403 shows that the sub-band signals were encoded in the frequency domain, the sub-band signals losslessly encoded in the frequency domain are received and losslessly decoded (operation 1405). Examples of the frequency domain decoding include AAC and BSAC.

The sub-band signals losslessly decoded in operation 1405 are de-quantized (operation 1410).

In order to reduce quantization noise, noise is controlled so that a temporal envelope of each of the sub-band signals de-quantized in operation 1410 is constant (operation 1415). A TNS operation may be performed in operation 1415.

If the determination result of operation 1403 shows that the sub-band signals are encoded in the time domain, the sub-band signals encoded in the time domain using the CELP method are received and then decoded using the CELP method (operation 1420).

The sub-band signals each containing noise controlled in operation 1415 and the sub-band signals decoded in operation 1420 are synthesized and then inverse-transformed to the time domain (operation 1425). The transform method used in operation 1425 may be the inverse FV-MLT method.

The signal inverse-transformed in operation 1425 is transformed (operation 1430). The transform method used in operation 1430 may be the MDCT method, the MDST method, the FFT method, or the QMF method.

Information for generating the high frequency band signal by using the low frequency band signal is received, and the high frequency band signal is generated by using the signal transformed in operation 1430 (operation 1435).

Information for generating a stereo signal is received, and the stereo signal is generated using the stereo tool (operation 1450).

The stereo signal generated in operation 1450 is inverse-transformed using an inverse transform method corresponding to the transform of operation 1430 (operation 1455).

Figure 15:
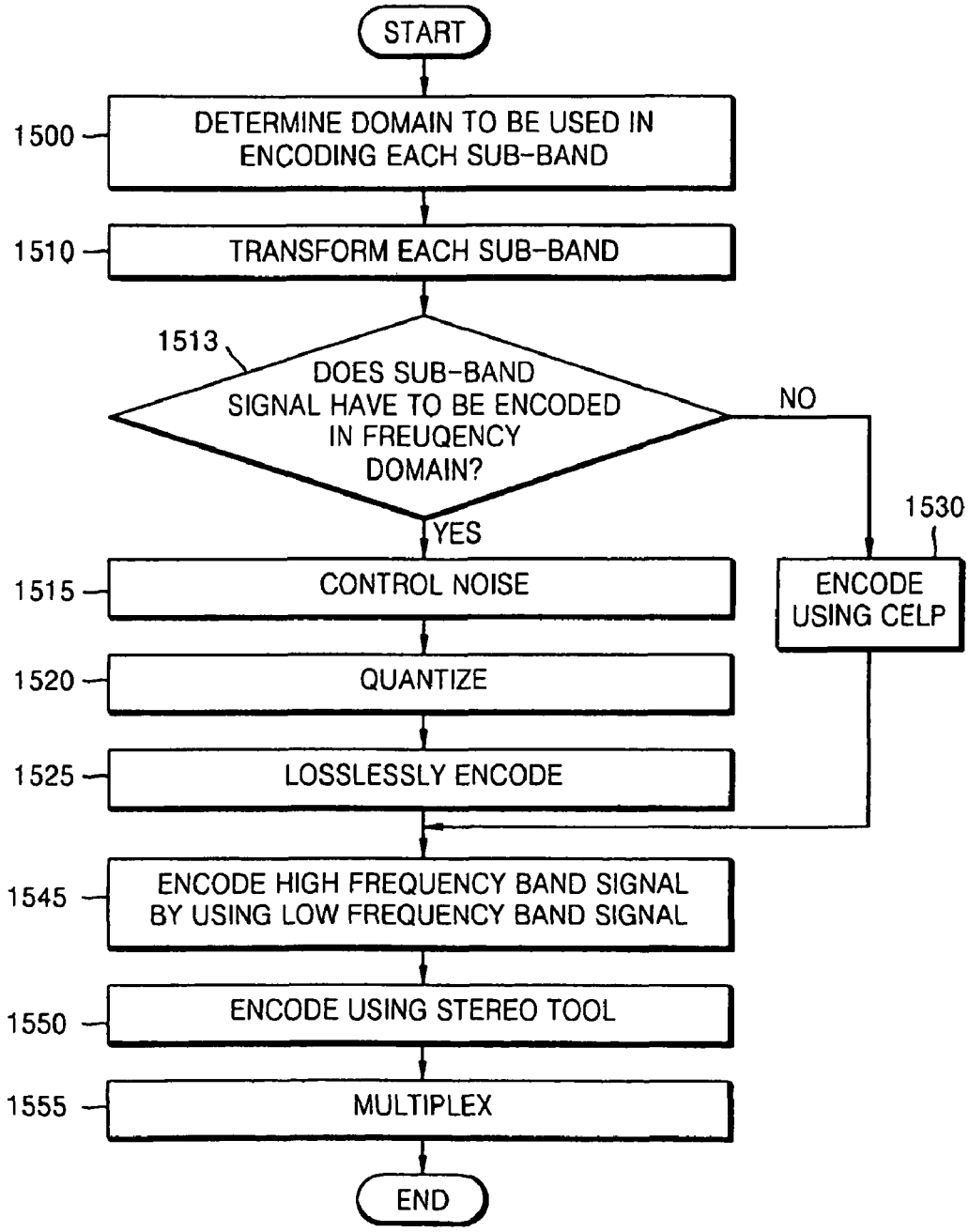
FIG. 15 is a flowchart illustrating a method of bandwidth extension encoding according to another exemplary embodiment.

FIG. 15 is a flowchart illustrating a method of bandwidth extension encoding according to another exemplary embodiment.

First, it is determined whether each sub-band signal will be encoded in the frequency domain or the time domain (operation 1500). When a domain to be used in encoding is determined in operation 1500, as shown in FIG. 15, only an input signal of the time domain may be used. On the other hand, the input signal may be transformed to the frequency domain or the time domain for each of a plurality of sub-bands, and thereafter signals transformed for each sub-band may be used. Alternatively, the input signal and the signals transformed for each sub-band may all be used.

For each sub-band, the input signal is transformed to the frequency domain or the time domain determined for each sub-band in operation 1500 (operation 1510). In operation 1510, the FV-MLT method may be used.

It is then determined whether each sub-band signal is transformed to the frequency domain or the time domain in operation 1510 (operation 1513).

If the determination result of operation 1513 shows that each sub-band signal is transformed to the frequency domain, in order to reduce quantization noise, noise is controlled so that a temporal envelope of each of the sub-band signals transformed to the frequency domain in operation 1510 is constant (operation 1515). A TNS operation may be performed in operation 1515.

The signal containing noise controlled in operation 1515 is quantized (operation 1520).

The signal quantized in operation 1520 is losslessly encoded (operation 1525). Examples of the frequency domain encoding include AAC and BSAC.

If the determination result of operation 1513 shows that the sub-bands are transformed to the time domain, the sub-band signals transformed to the time domain in operation 1510 are encoded using the CELP method (operation 1530). Encoding performed in operation 1530 is not limited to the CELP method, and thus another method may be used as long as encoding is performed in the time domain.

The high frequency band signal is encoded by using the low frequency band signal from the signal which is transformed to the time domain or the frequency domain for each sub-band in operation 1540 (operation 1545). In operation 1545, information for generating the high frequency band signal is encoded by using the low frequency band signal to be decoded at a decoding end.

The signal transformed to the time domain or the frequency domain for each sub-band in operation 1510 is analyzed using the stereo tool, and information for generating a stereo signal at the decoding end is encoded (operation 1550).

The signal encoded in operation 1525, the signal encoded in operation 1530, the signal encoded in operation 1545, and the signal encoded in operation 1550 are multiplexed to generate a bit-stream (operation 1555).

Figure 16:
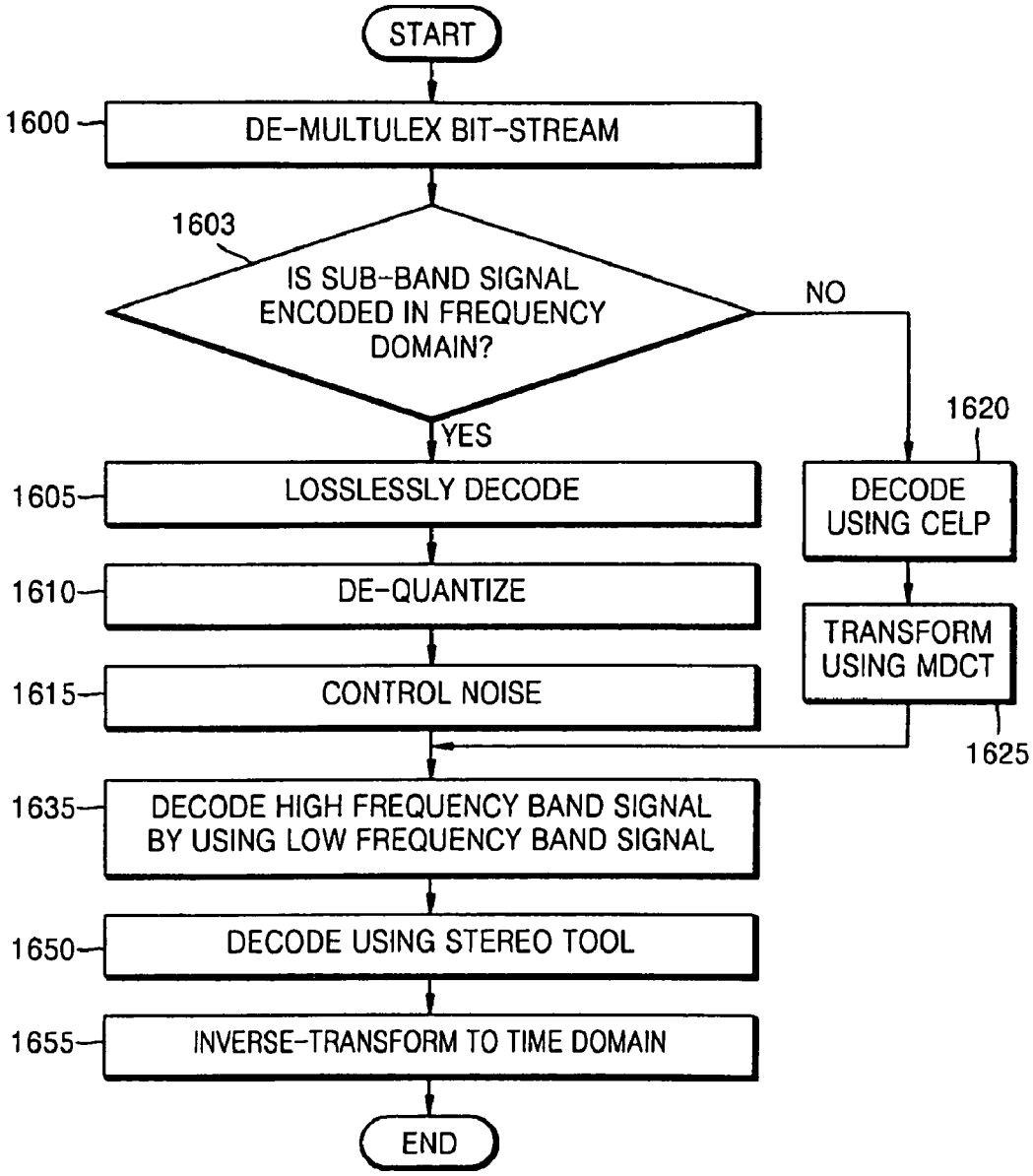
FIG. 16 is a flowchart illustrating a method of bandwidth extension decoding according to another exemplary embodiment.

FIG. 16 is a flowchart illustrating a method of bandwidth extension decoding according to another exemplary embodiment.

First, a bit-stream is received from an encoding end and de-multiplexed (operation 1600).

After operation 1600, it is determined whether each sub-band signal was encoded in the frequency domain or the time domain at the encoding end (operation 1603).

If the determination result of operation 1603 shows that the sub-band signals were encoded in the frequency domain, sub-band signals losslessly encoded in the frequency domain are received and losslessly decoded (operation 1605). Examples of the frequency domain decoding include AAC and BSAC.

The sub-band signals losslessly decoded in operation 1605 are de-quantized (operation 1610).

In order to reduce quantization noise, noise is controlled so that a temporal envelope of each of the sub-band signals de-quantized in operation 1610 is constant (operation 1615). A TNS operation may be performed in operation 1615.

The sub-band signals encoded in the time domain at the encoding end using the CELP method are received and then decoded using the CELP method (operation 1620).

The signal decoded in operation 1620 undergoes the MDCT so that the low frequency band signal is transformed from the time domain to the frequency domain (operation 1625).

Information for generating the high frequency band signal is received by using the low frequency band signal, and the high frequency band signal is generated by using the signal containing noise controlled in operation 1615 or the low frequency band signal transformed in operation 1625 (operation 1635).

Information for generating a stereo signal is received, and the stereo signal is generated using the stereo tool (operation 1650). The sub-band signals generated as stereo signals in operation 1650 are synthesized and then inverse-transformed to the time domain (operation 1655). The transform method used in operation 1655 may be the inverse FV-MLT method.

According to a method of bandwidth extension encoding and decoding, a high frequency band signal is encoded and decoded by using a low frequency band signal. Therefore, encoding and decoding can be performed with a small data size while not reducing sound quality.

In addition to the above-described exemplary embodiments, exemplary embodiments can also be implemented by executing computer readable code/instructions in/on a medium/media, e.g., a computer readable medium/media. The medium/media can correspond to any medium/media permitting the storing and/or transmission of the computer readable code/instructions. The medium/media may also include, alone or in combination with the computer readable code/instructions, data files, data structures, and the like. Examples of code/instructions include both machine code, such as produced by a compiler, and files containing higher level code that may be executed by a computing device and the like using an interpreter. In addition, code/instructions may include functional programs and code segments.

The computer readable code/instructions can be recorded/transferred in/on a medium/media in a variety of ways, with examples of the medium/media including magnetic storage media (e.g., floppy disks, hard disks, magnetic tapes, etc.), optical media (e.g., CD-ROMs, DVDs, etc.), magneto-optical media (e.g., floptical disks), hardware storage devices (e.g., read only memory media, random access memory media, flash memories, etc.) and storage/transmission media such as carrier waves transmitting signals, which may include computer readable code/instructions, data files, data structures, etc. Examples of storage/transmission media may include wired and/or wireless transmission media. For example, storage/transmission media may include optical wires/lines, waveguides, and metallic wires/lines, etc. including a carrier wave transmitting signals specifying instructions, data structures, data files, etc. The medium/media may also be a distributed network, so that the computer readable code/instructions are stored/transferred and executed in a distributed fashion. The medium/media may also be the Internet. The computer readable code/instructions may be executed by one or more processors. The computer readable code/instructions may also be executed and/or embodied in at least one application specific integrated circuit (ASIC) or Field Programmable Gate Array (FPGA).

In addition, one or more software modules or one or more hardware modules may be configured in order to perform the operations of the above-described exemplary embodiments.

The term "module", as used herein, denotes, but is not limited to, a software component, a hardware component, a plurality of software components, a plurality of hardware components, a combination of a software component and a hardware component, a combination of a plurality of software components and a hardware component, a combination of a software component and a plurality of hardware components, or a combination of a plurality of software components and a plurality of hardware components, which performs certain tasks. A module may advantageously be configured to reside on the addressable storage medium/media and configured to execute on one or more processors. Thus, a module may include, by way of example, components, such as software components, application specific software components, object-oriented software components, class components and task components, processes, functions, operations, execution threads, attributes, procedures, subroutines, segments of program code, drivers, firmware, microcode, circuitry, data, databases, data structures, tables, arrays, and variables. The functionality provided for in the components or modules may be combined into fewer components or modules or may be further separated into additional components or modules. Further, the components or modules can operate at least one processor (e.g. central processing unit (CPU)) provided in a device. In addition, examples of a hardware components include an application specific integrated circuit (ASIC) and Field Programmable Gate Array (FPGA). As indicated above, a module can also denote a combination of a software component(s) and a hardware component(s). These hardware components may also be one or more processors.

The computer readable code/instructions and computer readable medium/media may be those specially designed and constructed for the purposes of exemplary embodiments, or they may be of the kind well-known and available to those skilled in the art of computer hardware and/or computer software.

Although a few exemplary embodiments have been shown and described, it would be appreciated by those skilled in the art that changes may be made to exemplary embodiments, the scope of which is defined in the claims and their equivalents.

What is claimed is:

1. A method of bandwidth extension decoding, comprising:

checking whether a signal has been encoded in a frequency domain or a time domain;

performing lossless-decoding and de-quantization, and inverse-transforming the signal to the time domain if the checking result shows that the signal has been encoded in the frequency domain;

performing decoding of the signal using CELP (code excited linear prediction) if the checking result shows that the signal has been encoded in the time domain;

transforming the signal that has been inverse-transformed to the time domain, using a quadrature mirror filterbank (QMF), or transforming the signal that has been decoded using CELP, using the QMF;

generating a high frequency band signal using the transformed signal;

generating a stereo signal from the high frequency band signal and the transformed signal; and inverse-transforming the stereo signal using an inverse QMF.

2. A method of bandwidth extension decoding, comprising:

checking whether a signal has been encoded in a frequency domain or a time domain;

performing lossless-decoding and de-quantization, and inverse-transforming the signal to the time domain if the checking result shows that the signal has been encoded in the frequency domain;

performing decoding of the signal using CELP (code excited linear prediction) if the checking result shows that the signal has been encoded in the time domain;

transforming the signal that has been inverse-transformed to the time domain, using a quadrature mirror filterbank (QMF), or transforming the signal that has been decoded using CELP, using the QMF;

generating a high frequency band signal using the transformed signal;

generating an extended signal including the transformed signal and the high frequency band signal;

generating a stereo signal from the extended signal; and inverse-transforming the stereo signal using an inverse QMF.

* * * * *

UNITED STATES PATENT AND TRADEMARK OFFICE

CERTIFICATE OF CORRECTION

PATENT NO. : 8,239,193 B2
APPLICATION NO. : 12/585569
DATED : August 7, 2012
INVENTOR(S) : Oh et al.

It is certified that error appears in the above-identified patent and that said Letters Patent is hereby corrected as shown below:

On the Title Page Item [75] (Inventors), Line 2, delete "Jung-hoo" and insert -- Jung-hoe --, therefor.

Signed and Sealed this
Twenty-ninth Day of July, 2014

Michelle K. Lee

Michelle K. Lee
*Deputy Director of the United States Patent and Trademark Office*